US012378856B1

(12) United States Patent
Bridges et al.

(10) Patent No.: US 12,378,856 B1
(45) Date of Patent: Aug. 5, 2025

(54) PRODUCING FLUID FROM A WELL USING DISTRIBUTED ACOUSTIC SENSING AND AN ELECTRICAL SUBMERSIBLE PUMP

(71) Applicant: Halliburton Energy Services, Inc., Houston, TX (US)

(72) Inventors: Jeffrey Bridges, Tulsa, OK (US); Benjamin Schaeffer, Denver, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/627,074

(22) Filed: Apr. 4, 2024

(51) Int. Cl.
*E21B 43/12* (2006.01)
*E21B 47/14* (2006.01)

(52) U.S. Cl.
CPC ..... *E21B 43/128* (2013.01); *E21B 47/14* (2013.01)

(58) Field of Classification Search
CPC ..... E21B 47/13; E21B 47/135; E21B 47/14; E21B 43/128
See application file for complete search history.

(56) References Cited

U.S. PATENT DOCUMENTS

| | | | | |
|---|---|---|---|---|
| 8,708,664 | B2 | 4/2014 | Brookbank | |
| 10,415,373 | B2 | 9/2019 | Clarke et al. | |
| 11,066,921 | B1 * | 7/2021 | Brown | E21B 47/14 |
| 2013/0175030 | A1 | 7/2013 | Ige et al. | |
| 2014/0334253 | A1 | 11/2014 | Lumens et al. | |
| 2017/0167245 | A1 | 6/2017 | Dickenson et al. | |
| 2020/0200000 | A1 * | 6/2020 | Langnes | E21B 47/00 |
| 2021/0406792 | A1 | 12/2021 | Bhardwaj et al. | |
| 2022/0316314 | A1 | 10/2022 | Saghir et al. | |
| 2023/0417136 | A1 | 12/2023 | Gibson, Jr. | |

FOREIGN PATENT DOCUMENTS

| | | | |
|---|---|---|---|
| GB | 2549663 | A | 10/2017 |
| GB | 2555550 | A | 2/2018 |
| WO | 2023060162 | A1 | 4/2023 |

(Continued)

OTHER PUBLICATIONS

Foreign Communication from Related Application—International Search Report and Written Opinion of the International Searching Authority, International Application No. PCT/US2024/026507, dated Dec. 20, 2024, 12 pages.

(Continued)

*Primary Examiner* — Kristyn A Hall
(74) *Attorney, Agent, or Firm* — Conley Rose, P.C.; Rodney B. Carroll

(57) ABSTRACT

In some embodiments, a system for producing fluid from a well can include an electrical submersible pump (ESP) disposed in a wellbore of the well and configured to pump the fluid. The system may further include a distributed acoustic sensing (DAS) system, for example having an interrogator unit and a fiber optic cable extending downhole in the wellbore. An end of the fiber optic cable can be disposed downhole relative to the ESP. In embodiments, the system may further include a controller configured to receive data from the DAS system, process the data to detect a slug, determine a parameter of the detected slug, and alter operation of the ESP in response to determining that the parameter exceeds a threshold.

20 Claims, 9 Drawing Sheets

(56) References Cited

FOREIGN PATENT DOCUMENTS

WO 2023193877 A1 12/2023

OTHER PUBLICATIONS

Tabjula et al. Feature Extraction Techniques for Noisy Distributed Acoustic Sensor Data Acquired in a Wellbore, Research Gate (DOI: 10.1364/opticaopen.22027727), Feb. 2023, pp. 1-16.
Foreign Communication from Related Application—International Search Report and Written Opinion of the International Searching Authority, International Application No. PCT/US2024/026500, dated Dec. 24, 2024, 10 pages.

* cited by examiner

PRODUCING FLUID FROM A WELL USING DISTRIBUTED ACOUSTIC SENSING AND AN ELECTRICAL SUBMERSIBLE PUMP

CROSS-REFERENCE TO RELATED APPLICATIONS

None.

STATEMENT REGARDING FEDERALLY SPONSORED RESEARCH OR DEVELOPMENT

Not applicable.

FIELD

This disclosure relates generally to producing fluid from a well. More particularly, this disclosure relates to use of a distributed acoustic sensing (DAS) system downhole in a well, for example controlling an electrical submersible pump (ESP) based on data collected from the DAS system.

BACKGROUND

An ESP is a type of pump used in the oil industry to lift oil or water from wells. For example, an ESP may be used in wells where the pressure is not sufficient to bring the fluid to the surface. A typical ESP assembly comprises, from bottom to top, an electric motor, a seal unit, a pump intake, and a pump (e.g. typically a centrifugal pump), which are all mechanically connected together with shafts and shaft couplings. The electric motor supplies torque to the shafts, which provides power to the centrifugal pump. The electric motor is isolated from a wellbore environment by a housing and by the seal unit. The seal unit can act as an oil reservoir for the electric motor. The oil can function both as a dielectric fluid and as a lubricant in the electric motor. The seal unit also may provide pressure equalization between the electric motor and the wellbore environment.

The centrifugal pump is configured to transform mechanical torque received from the electric motor via a drive shaft to fluid pressure which can lift fluid up the wellbore. For example, the centrifugal pump typically has rotatable impellers within stationary diffusers. A shaft extending through the centrifugal pump is operatively coupled to the motor, and the impellers of the centrifugal pump are rotationally coupled to the shaft. In use, the motor can rotate the shaft, which in turn can rotate the impellers of the centrifugal pump relative to and within the stationary diffusers, thereby imparting pressure to the fluid within the centrifugal pump. The electric motor is generally connected to a power source located at the surface of the well using a cable and a motor lead extension. The ESP assembly is placed into the well and usually is inside a well casing. In a cased completion, the well casing separates the ESP assembly from the surrounding formation. In operation, perforations in the well casing allow well fluid to enter the well casing and flow to the pump intake for transport to the surface.

ESPs can be a versatile and efficient solution for lifting fluids from wells, particularly in the oil industry, but may require careful maintenance and/or operation due to the challenging operating conditions. One such challenging operation condition is the presence of slugs. In unconventional wells in particular, gas slugs and sand production (e.g. sand slugs and/or an overabundance of continuous sand production) can present a major detriment to ESP operational longevity. Slugs can create highly variable flow conditions. ESPs are typically designed for relatively consistent liquid flow. When a slug passes through an ESP, the sudden change in flow rate and pressure can cause the pump to operate inefficiently, or even stop. When a gas slug enters the pump, it can lead to cavitation, or the formation of vapor cavities in a liquid. This occurs when the local pressure falls below the liquid's vapor pressure. Cavitation can damage the pump impellers and other components, leading to reduced pump life and/or efficiency. The pump motor can experience electrical overload when trying to process a slug, as the motor works harder to maintain performance. Conversely, when the slug passes and normal liquid flow resumes, the motor can suddenly be underloaded, which can also harm the motor and controls. Slugs can cause temperature fluctuations inside the pump. ESPs are designed to operate within a certain temperature range, and deviations can affect the motor's insulation and overall performance. The inconsistent nature of slug flow can lead to increased wear and tear on the pump's mechanical and electrical components, as the pump adjusts to the varying fluid characteristics. In severe cases, slugs can cause the ESP to shut down, requiring a restart. A significant number of ESP failures are directly related to continued operation during gas slug flow, sand slugs, and an overabundance of continuous sand production. High ESP failure rates can cause well production with ESPs to become uneconomical.

Frequent shutdowns and restarts due to slugs not only can reduce the overall efficiency of the well operation, but also can diminish the life of the ESP. To attempt to mitigate these issues, flow conditioning and slug catchers upstream have been used. However, these strategies have had limited success. Accordingly, there may be a need for improved systems and methods to help an ESP downhole in a well to better handle issues arising from slugs.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid.

Disclosed embodiments relate generally to controlling an ESP based on data collected from a DAS system, which may provide one or more indicators of gas or sand. An operational setpoint of the ESP may be altered based on readings from the DAS system. Timing of the altered operational setpoint may be linked to the timing of the arrival of the slug at the ESP. The ESP may be controlled based on the readings from the DAS system, for example to reduce flow (e.g. idle the ESP) or stop flow (e.g. shut down the ESP) so as to prevent or minimize damage when the gas or sand flows through it. Disclosed embodiments may provide improved production from wells. That is, oil or other valuable fluid may be extracted from a well at a higher rate and/or at lower cost as compared with conventional methods. In addition, disclosed embodiments may reduce unexpected downtime of the ESP and/or may improve life of the ESP. These and other advantages will be understood by persons of skill with reference to the disclosure herein. Various embodiments will be discussed in detail below.

Figure 1:
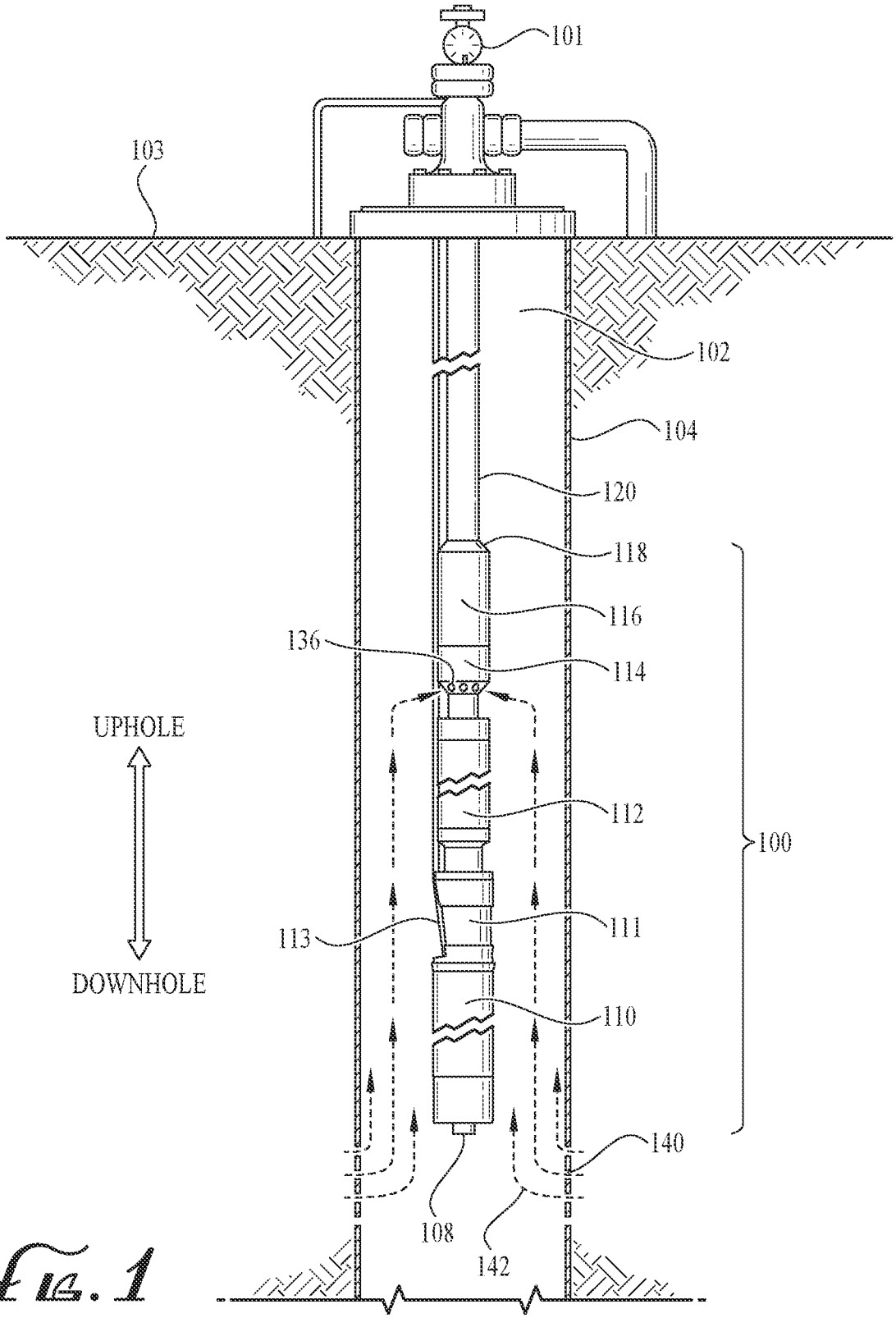
FIG. 1 is a schematic illustration of an exemplary electrical submersible pump (ESP) disposed in a wellbore, according to an embodiment of the present disclosure.

Referring to FIG. 1, an exemplary producing well environment is shown. In an embodiment, the environment comprises a wellhead 101 above a wellbore 102 located at the surface 103. A casing 104 is provided within the wellbore 102. An ESP 100 is deployed downhole in a well within the casing 104 and comprises an optional sensor unit 108, an electric motor 110 with a motor head 111, a seal unit 112, an electric power cable 113, a pump intake 114, a centrifugal pump 116, and a pump outlet 118 that couples the centrifugal pump 116 to a production tubing 120. The ESP 100 may be fluidly coupled to production tubing 120 (for example at the bottom of the production tubing 120, as shown in FIG. 1), and in some embodiments may be coupled within the production tubing 120 (e.g. between an upper portion of the production tubing and a lower portion of the production tubing). Typically, the seal unit 112 of the ESP 100 may be disposed between the electric motor 110 and the centrifugal pump 116. The centrifugal pump 116 is operatively coupled to the motor 110 by a shaft (not shown), which may extend through the seal unit 112. In an embodiment, the ESP 100 may employ thrust bearings in several places, for example in the electric motor 110, in the seal unit 112, and/or in the centrifugal pump 116. While not shown in FIG. 1, in an embodiment, the ESP 100 can comprise a gas separator that may employ one or more thrust bearings. The motor head 111 couples the electric motor 110 to the seal unit 112. The electric power cable 113 may connect to a source of electric power at the surface 103 and to the electric motor 110 and may be configured to provide power from the source of electric power at the surface 103 to the electric motor 110.

The casing 104 is pierced by perforations 140, and reservoir fluid 142 flows through the perforations 140 into the wellbore 102. Although these perforations 140 are shown in the vertical portion of the wellbore 102, they can also be located in a horizontal portion of the wellbore 102 (not shown in FIG. 1). The fluid 142 flows downstream in an annulus formed between the casing 104 and the ESP 100, is drawn into the pump intake 114, is pumped by the centrifugal pump 116, and is lifted through the production tubing 120 to the wellhead 101 to be produced at the surface 103. The fluid 142 may comprise hydrocarbons such as oil, water, or both hydrocarbons and water.

While the example illustrated in FIG. 1 relates to land-based subterranean wells, similar ESP systems can be used in a subsea environment and/or may be used in subterranean environments located on offshore platforms, drill ships, semi-submersibles, drilling barges, etc. And while the wellbore is shown in FIG. 1 as being approximately vertical, in other embodiments, the wellbore may be horizontal, deviated, or any other type of well. Also, while the pump of the ESP is described with respect to FIG. 1 as a centrifugal pump, other types of pumps (such as a rod pump, a progressive cavity pump, any other type of pump suitable for the system, or combinations thereof) may be used instead.

Figure 2:
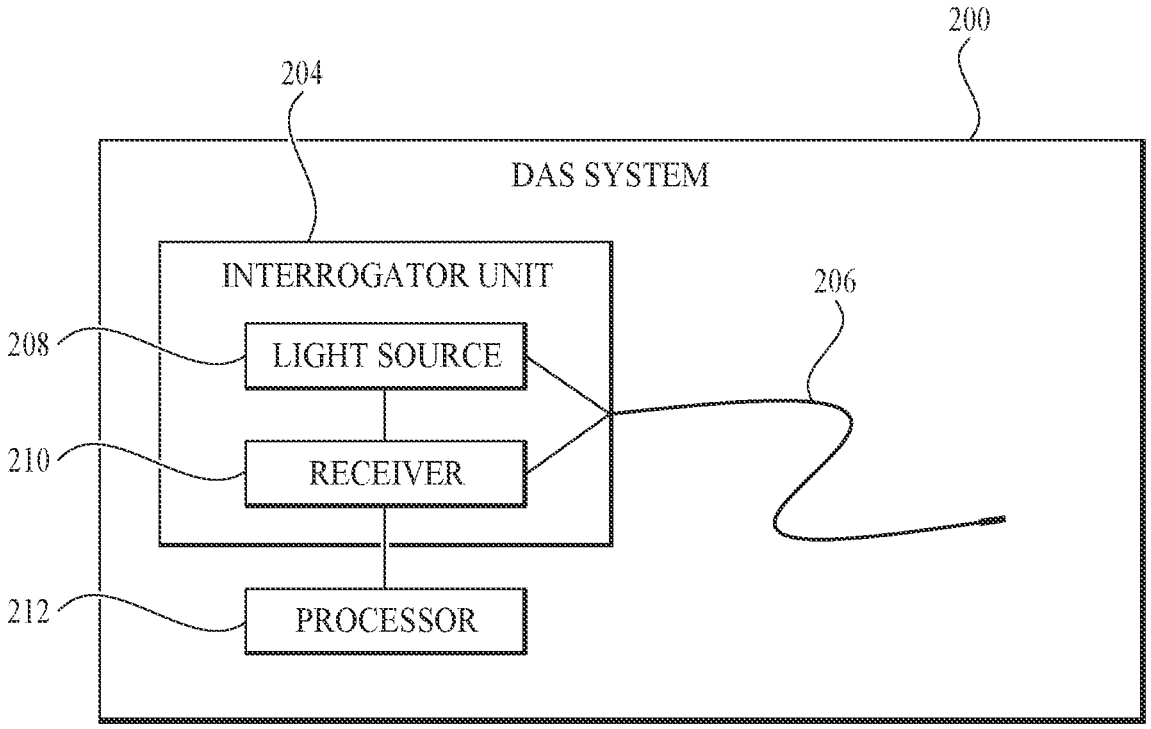
FIG. 2. is a block diagram of an exemplary DAS system, according to an embodiment.

FIG. 2 illustrates a block diagram of an exemplary DAS system 200 in accordance with embodiments of the present disclosure. Embodiments of the present disclosure may employ a fiber-optic cable-based DAS system 200 to detect and/or record acoustic signals. In some embodiments, the DAS system 200 may include a fiber optic cable 206. In some embodiments, the DAS system may include receiving sensors (e.g., acoustic and/or seismic sensors) such as fiber-optic sensors, geophones, optical hydrophones, accelerometers, fiber-optic interferometric sensors, and/or like to measure acoustic data and/or seismic data. FIG. 2 shows a particular configuration of components of the DAS system 200. However, any suitable configurations of components may be used. The DAS system 200 of FIG. 2 includes an interrogator unit 204. The fiber optic cable 206 (e.g. the proximal end of the fiber optic cable 206) may be coupled to the interrogator unit 204, for example communicatively coupled. The interrogator unit 204 may include a light source 208 and a receiver 210. The light source 208 (e.g., a laser) is configured to emit a coherent light into the fiber optic cable 206, and the receiver 210 is configured to receive backscattered light from the fiber optic cable 206. While a specific DAS system is described, it should be understood that any combination of optical and/or electrical sensors, and electrical and/or optical interrogators, fall within the scope of the present disclosure.

The interrogator 204 may be connected (e.g. communicatively coupled) to a processor 212 through a connection, which may be wired and/or wireless. The processor 212 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. The processor 212 may include random access memory (RAM), one or more processing resources such as a central processing unit (CPU) or hardware or software control logic, ROM, and/or other types of nonvolatile memory. Additional components of the processor 212 may include one or more disk drives, one or more network ports for communication with external devices as well as an input device (e.g., keyboard, mouse, etc.), and video display. The processor 212 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media 240 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory. Systems and methods of the present disclosure may also be implemented through communications media such as wires, optical fibers, microwaves, radio waves, and other electromagnetic and/or optical carriers; and/or any combination of the foregoing.

In some examples, the DAS system 200 may interrogate the fiber optic cable 206 using coherent radiation (e.g. emitted by the light source 208) and relies on interference effects to detect seismic disturbances on the fiber optic cable 206. For example, a mechanical strain on a section of optical fiber can modify the optical path length for scattering sites on the fiber optic cable 206, and the modified optical path length can vary the phase of the backscattered optical signal. The phase variation can cause interference among backscattered signals from multiple distinct sites along the length of the fiber optic cable 206 and thus affect the intensity and/or phase of the optical signal detected by the DAS system 200 (e.g. the receiver 210). In some embodiments, the seismic disturbances on the fiber optic cable 206 are detected by analysis of the intensity and/or phase variations in the backscattered signals.

In some embodiments, the processor 212 is used to process raw data from the DAS system 200. Processing of the raw data may involve several steps. For example, the DAS unit can send a laser/light pulse down the fiber optic cable 206. As this light pulse travels along the fiber optic cable 206, part of the light is scattered back towards the source due to natural imperfections and variations within the fiber. The backscattered light, carrying information about any acoustic or vibrational events that affected the cable, is collected by the receiver 210. The DAS system 200 measures the time it takes for the backscattered light to return. Since the speed of light in the fiber is known, this time measurement can be used to calculate the distance along the cable where the interaction occurred. Using the time-of-flight data, the DAS system 200 can determine the location along the cable where each acoustic event was detected.

In some embodiments, the DAS system 200 analyzes, using the processor 212, changes in the phase, intensity, and/or frequency of the backscattered light. These changes are caused by the interaction of the light with the acoustic events along the fiber optic cable 206. Algorithms may be used by the processor 212 to filter out noise and irrelevant signals, enhancing the quality of the data. The processor 212 may analyze the processed signals to recognize patterns associated with specific types of acoustic events, such as fluid flow, mechanical vibrations, or seismic activity. The processor 212 may categorize events based on their acoustic signatures. This classification may include identifying the nature of the event, its intensity, and other characteristics or parameters. The processed data may be visualized in a user-friendly format, such as graphs, charts, or heat maps, to represent the acoustic activity along the cable. DAS data may be integrated with data from other types of sensors (like temperature or pressure sensors) to provide a more comprehensive understanding of the monitored environment. The system may be calibrated with known events or validated against other monitoring technologies to ensure accuracy.

Embodiments of the present disclosure include utilizing the fiber optic cable 206 for distributed acoustic sensing across the well profile, for example to identify gas and/or sand slugs as they migrate from the horizontal section of well to the position of the ESP 100. This enables action to be taken by operators or in an automated fashion (e.g., by a controller) to identify harmful conditions prior to the slug reaching the ESP 100 and, in response, either change operation of the ESP 100 or power down the ESP 100 to prevent potential damage or unrecoverable failure of the ESP 100. The DAS system 200 can be used to identify and quantify gas slugs, sand slugs, or other types of slugs (e.g., liquid slugs, emulsion slugs, or foam slugs) prior to the slug reaching the ESP. Multi-phase flow meters on well tubing and annulus sides may also be used to identify slug flow from the surface. Early warning systems (e.g., a warning shown on a display) can be established to warn of incoming slugs. Surface setting routines may be developed for slug handling and avoidance.

Figure 3A:
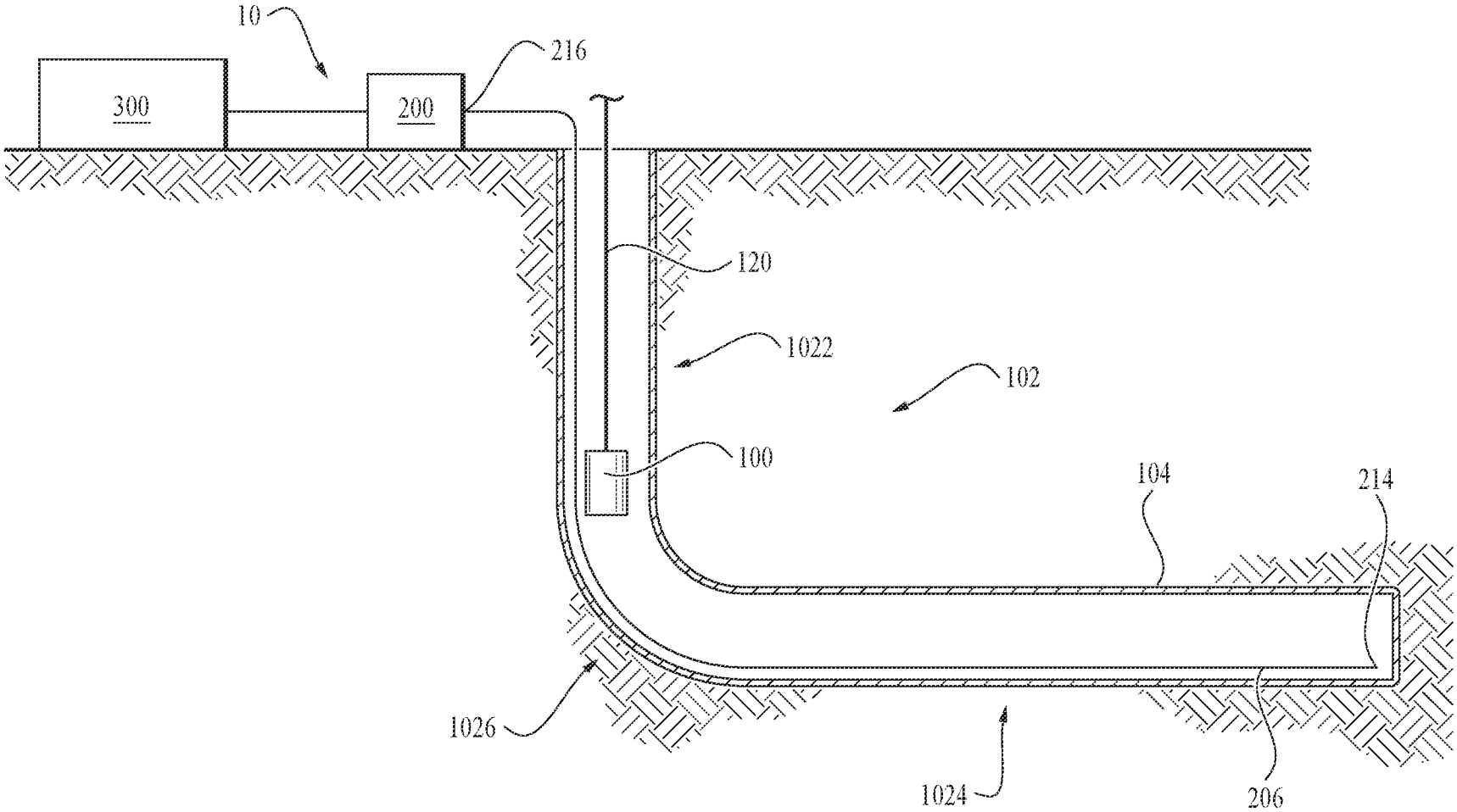
FIG. 3A is a schematic diagram of an exemplary system for producing fluid from a well, according to an embodiment.
Figure 3B:
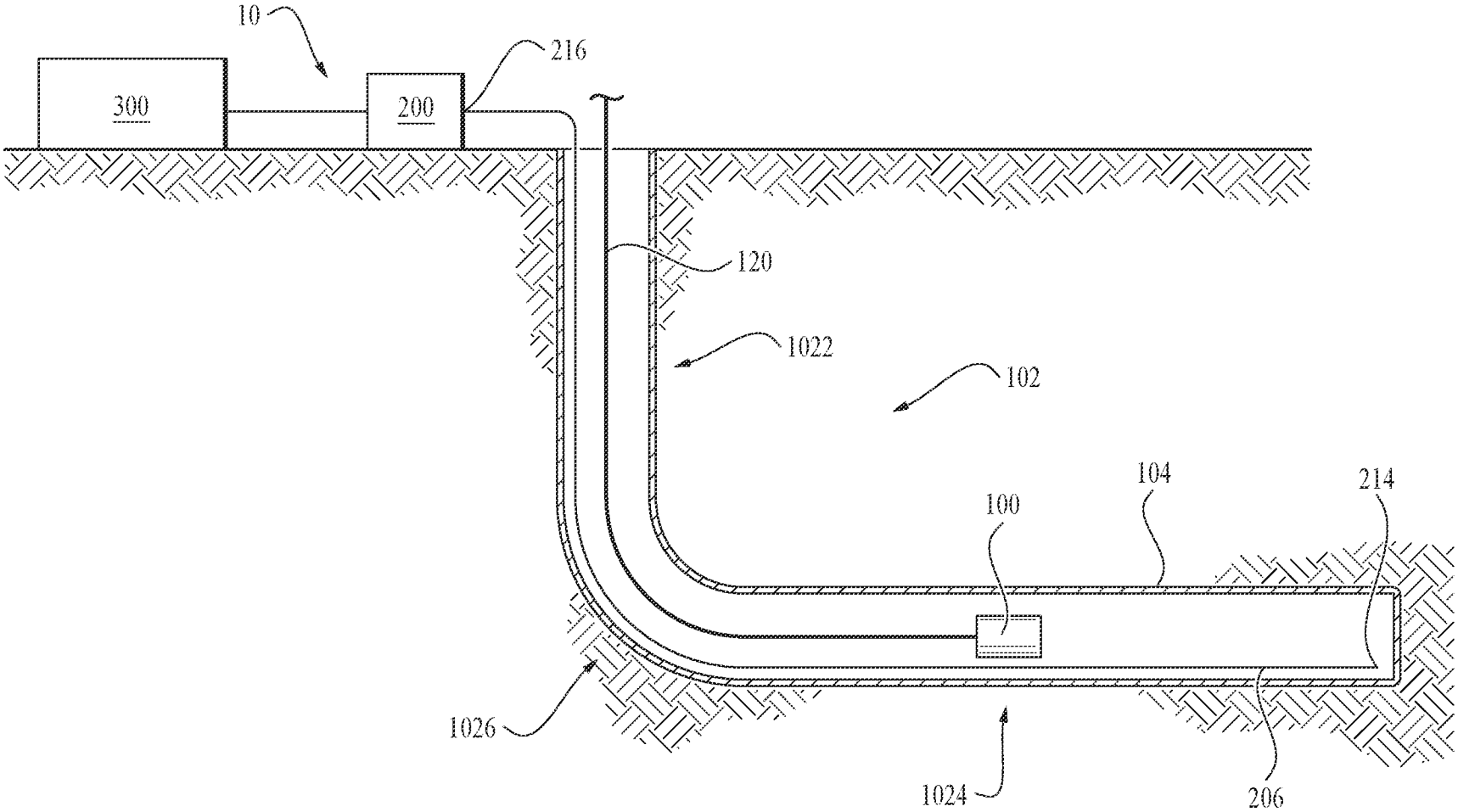
FIG. 3B is a schematic diagram of the system of FIG. 3A with the ESP in a different exemplary location.

As shown in FIGS. 3A and 3B, an exemplary system 10 for producing a fluid from a well is provided. Referring to FIGS. 2, 3A, and 3B, the system 10 includes an ESP 100 disposed in a wellbore 102 of the well and configured to pump fluid in an uphole direction to produce fluid from the well (e.g. to the surface of the well). The ESP 100 may be located in a vertical portion 1022 (as shown in FIG. 3A), a horizontal portion 1024 (as shown in FIG. 3B), or the curved portion (e.g. bend) 1026 of the well. The system 10 further includes a DAS system 200, which includes the interrogator unit 204 and the fiber optic cable 206 extending downhole within the wellbore (e.g. from the surface of the well to downhole in the well, for example along the wellbore 102). The fiber optic cable 206 may extend along the entire length of the wellbore 102 or partially along the length of the wellbore 102. An end (e.g. the distal end) 214 of the fiber optic cable 206 is disposed downhole relative to the ESP 100. In embodiments, the fiber optic cable 206 may be disposed on tubing 120 extending into the wellbore 102, in a groove in the tubing 120, inside the tubing 120, between the tubing 120 and casing 104 extending into the wellbore 102, in a groove in the casing 104, inside the casing 104, outside of the casing 104, and/or at any other suitable location. In some embodiments, the fiber optic cable 206 may be positioned downhole during installation of the DAS system 200. In other embodiments, the fiber optic cable 206 may have already been present in the wellbore (e.g. used previously for one or more earlier operation downhole), and installation of the DAS system may involve communicatively coupling the interrogator unit 204 to the fiber optic cable 206.

In FIGS. 3A-3B, the system 10 further includes a controller 300 in communication with the DAS system 200. In embodiments, the controller 300 may be configured to receive data from the DAS system 200, process the data to detect a slug, determine a parameter of the detected slug, and/or alter operation of the ESP 100, in response to determining that the parameter exceeds a threshold. In embodiments, the controller may be configured to receive data from the DAS system (e.g. from the processor or receiver); process or evaluate the data to detect a slug; determine a parameter of the detected slug; compare the parameter to a (e.g. pre-set) threshold; and alter operation of the ESP. In some embodiments, altering operation of the ESP may be in response to the parameter exceeding the threshold. In embodiments, the parameter may be determined based on the data from the DAS system 200 (e.g. data from the receiver 210). While the controller 300 is shown as a separate and/or independent component, in other embodiments the controller 300 may be integrated into or operated as part of the DAS system (e.g. the processor 212 may be configured to serve as and/or provide the functionality of the controller).

The controller 300 may include an information handling system (e.g. comprising one or more processor). A processor or central processing unit (CPU) of the controller 300 may be communicatively coupled to a memory controller hub (MCH) or north bridge. The processor may include, for example a microprocessor, microcontroller, digital signal processor (DSP), application specific integrated circuit (ASIC), or any other digital or analog circuitry configured to interpret and/or execute program instructions and/or process data. Processor may be configured to interpret and/or execute program instructions or other data retrieved and stored in any memory (which may for example be a non-transitory computer-readable medium, configured to have program instructions stored therein, or any other programmable storage device configured to have program instructions stored therein) such as memory or hard drive. Program instructions or other data may constitute portions of a software or application, for example application or data, for carrying out one or more methods described herein. Memory may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application or data may be retrieved and stored in memory for execution or use by processor. In one or more embodiments, the memory or the hard drive may include or comprise one or more non-transitory executable instructions that, when executed by the processor, cause the processor to perform or initiate one or more operations or steps. The information handling system may be preprogrammed or it may be programmed (and reprogrammed) by loading a program from another source (for example, from a CD-ROM, from another computer device through a data network, or in another manner).

The data may include data from the DAS system 200. Data received by the controller 300 (e.g. from the DAS system 200 and/or one or more sensors) may be used to carry out operations with respect to the ESP 100 and/or system 10. For example, the controller 300 may evaluate the data and determine one or more action based on the evaluation. In some embodiments, the controller 300 may automatically take action based on the evaluation.

The one or more applications may comprise one or more software applications, one or more scripts, one or more programs, one or more functions, one or more executables, or one or more other modules that are interpreted or executed by the processor. The one or more applications may include machine-readable instructions for performing one or more of the operations related to any one or more embodiments of the present disclosure. The one or more applications may include machine-readable instructions for generating a user interface or a plot. The one or more applications may obtain input data from the memory, from another local source, or from one or more remote sources (for example, via the one or more communication links). The one or more applications may generate output data and store the output data in the memory, hard drive, in another local medium, or in one or more remote devices (for example, by sending the output data via the communication link).

Memory controller hub may include a memory controller for directing information to or from various system memory components within the information handling system, such as memory, storage element, and hard drive. The memory controller hub may be coupled to memory and a graphics processing unit (GPU). Memory controller hub may also be coupled to an I/O controller hub (ICH) or south bridge. I/O controller hub can be coupled to storage elements of the information handling system, including a storage element, which may comprise a flash ROM that includes a basic input/output system (BIOS) of the computer system. I/O controller hub can also be coupled to the hard drive of the information handling system. I/O controller hub may also be coupled to an I/O chip or interface, for example, a Super I/O chip, which is itself coupled to several of the I/O ports of the computer system, including a keyboard, a mouse, a monitor (or other display) and one or more communications link. Any one or more input/output devices receive and transmit data in analog or digital form over one or more communication links such as a serial link, a wireless link (for example, infrared, radio frequency, or others), a parallel link, or another type of link. The one or more communication links may comprise any type of communication channel, connector, data communication network, or other link. For example, the one or more communication links may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to the controller 300 or any components or elements thereof without departing from the scope of the present disclosure. Any suitable configurations of components may be used. For example, components of controller 300 may be implemented either as physical or logical components. Furthermore, in some embodiments, functionality associated with components of controller 300 may be implemented in special purpose circuits or components. In other embodiments, functionality associated with components of controller 300 may be implemented in configurable general-purpose circuit or components. For example, components of controller may be implemented by configured computer program instructions.

The interrogator unit 204 includes a light source 208 configured to emit coherent light into the fiber optic cable 206 and a receiver 210 configured to receive backscattered light from the fiber optic cable 206. The DAS system 200 further includes a processor 212 configured to generate the data based on the backscattered light, and send the generated data 212 to the controller 300. The data may be processed by the controller 300 to detect the slug, determine a parameter of the slug, determine whether an action should be taken, determine an appropriate action, and/or control the ESP 100 to execute the action.

In some embodiments, the slug can be detected based on measured depth range of the slug. In the DAS system 200, the optical fiber cable 206 can act as a continuous line of sensors. The entire length of the fiber optic cable 206 can sense vibrations, sounds, or other acoustic signals. The light source 208 sends short pulses of light (e.g., a laser) through the fiber optic cable 206. This light travels down the length of the fiber optic cable 206. As the light pulse travels along the fiber, some of the light is scattered in all directions due to imperfections or intrinsic properties of the fiber. This phenomenon is known as Rayleigh backscatter. Depth range can be determined based on the time delay between when a pulse is sent and when the scattered light is received. Since light travels at a known speed in the fiber cable 206, this time delay can be translated into a distance. By analyzing changes in the backscatter pattern over time, the DAS system 200 can pinpoint where along the fiber these changes occurred. This location corresponds to the depth range of the acoustic event relative to the starting point of the fiber. The size of the slug (e.g., plume of gas) can be determined by measuring the depth range. For example, by counting the number of sensing points (e.g. along the length of the fiber optic cable 206) that are signaling the presence of gas, the size and position of the slug may be monitored as the slug travels up the wellbore 102.

In some embodiments, the slug can be detected based on a tension in the fiber optic cable 206. Measuring the tension in the fiber optic cable 206 involves a process that detects and analyzes changes in the properties of light within the fiber optic cable 206. The fiber optic cable 206 is sensitive to physical changes such as strain and temperature. When the fiber optic cable 206 is under tension, it experiences strain, which slightly alters its physical dimensions and the refractive index of the fiber. These changes affect how light travels through the fiber. When the fiber is under tension, the characteristics of the backscattered light change. Specifically, tension can cause slight changes in the frequency (or phase) of the backscattered light, a phenomenon known as strain-induced birefringence. The DAS system 200 can analyze the time it takes for the backscattered light to return and its frequency characteristics. By comparing these characteristics with the baseline (the state of the fiber when it is not under tension), the system can detect changes that indicate tension. The amplitude of the tension in the fiber optic cable 206 can be indicative of the amount of gas in the slug. The parameter may be based on the shape or amplitude of one or more zones of tension within the fiber optic cable 206, which is indicative of the quantity of gas coming up the wellbore 102 at a given time. The controller 300 may compare this parameter to the threshold (e.g., the threshold of the shape or amplitude of tension within the fiber optic cable 206 that would cause damage to the ESP 100), and based on a result of the comparison, alter operation of the ESP 100. For example, in response to determining that the parameter is less than the threshold, the controller 300 may not alter operation of the ESP 100. In response to determining that the parameter is greater than the threshold, the controller 300 may alter operation of the ESP 100 (e.g. as discussed in more detail below). Sand slugs can cause a different tension signal than gas slugs. In embodiments, the controller 300 can distinguish between sand slugs and gas slugs based on the tension signal. In some embodiments, the controller 300 sets the threshold based on whether the detected slug is a sand slug or a gas slug.

In embodiments, the parameter may include, be, or be based on a depth range of the slug, a tension in the fiber optic cable 206, a magnitude of an acoustic signal received by the fiber optic cable 206, an estimated length of the slug, an estimated volume of the slug, and/or an estimated mass of the slug. In some embodiments, the controller 300 may determine more than one parameter. In other embodiments, the controller 300 may determine one or more parameter each based on multiple readings such as the acoustic signal received by the fiber optic cable 206 and the tension in the fiber optic cable 206. In some embodiments, the parameter may include a severity rating based on a position of the slug, a velocity of the slug, a length of the slug, a volume of the slug, and/or a mass of the slug. In some embodiments, the severity rating can be determined based on a model. For example, the model may be a machine learning model. In some embodiments, the parameter includes a mass of the slug. The mass of the slug may be estimated based on a measured depth range of the slug, a tension in the fiber optic cable 206, a magnitude of acoustic signal received by the fiber optic cable 206, or some combination of these. The slug may be a gas slug or a sand slug in the fluid. In some embodiments, the parameter can be based on an acoustic signal of less than 1 Hz (e.g. analysis of the low frequency components of the DAS system 200). For example, by analyzing low frequency components (e.g. less than 1 Hz) of the signal from the DAS system 200, the controller 300 may detect the slug and/or determine the size, mass, or volume of the slug. DAS data at that frequency scale is very sensitive to temperature effects when gas comes out of solution, which can make it possible to detect plumes of gas or gas slugs at a particular location in the well and at a particular time. That is, the signals coming from the DAS system 200 can be interpreted to estimate where a slug is at a particular time. As the reservoir depletes, pressure drops in the reservoir can cause gas to come out of solution, which in turn can create a bulge in low frequency data due to the flow through the casing 104 of the wellbore 102. Observations at such frequencies can be used to drive one or more predictive models upon which the parameters can be based.

In some embodiments, the alteration of the operation of the ESP 100 may include stopping the ESP 100 (e.g. stop providing power to the ESP 100) or bringing the ESP 100 to an idle state. For example, the ESP 100 may be running at nominal speed, and in response to the controller 300 detecting a slug of a magnitude above a threshold (e.g. which may be set based on potential damage to the ESP), the controller 300 may reduce the speed of the ESP 100 from nominal speed to approximately zero. In other embodiments, the ESP 100 may be running at nominal speed, and in response to the controller 300 detecting a slug of a magnitude above a threshold, the controller 300 may reduce the speed of the ESP 100 from nominal speed to idle speed (e.g. approximately 30 Hz to 40 Hz). This may reduce the flow rate in the well, and in some instances may bring the flow rate to approximately that based on the well formation's own pressure. The stopping of the ESP 100 or the bringing of the ESP 100 to the idle speed may prevent or mitigate damage to the ESP 100 as a result of the slug passing through the ESP 100. That is, if the slug passes through the ESP 100 while the ESP 100 is stopped or at idle speed, internal components of the ESP 100 may not be damaged. If the ESP 100 had continued at full power when the slug passed through it, the ESP 100 may have been damaged or may experience unexpected down time. In some embodiments, in response to detecting that the slug has passed the ESP 100, the controller 300 brings the ESP 100 from zero to nominal speed (e.g. for pumping fluid uphole, for example at a specified flow rate). In some embodiments, in response to detecting that the slug has passed the ESP 100, the controller 300 brings the ESP 100 from idle speed to nominal speed.

In some embodiments, the threshold can be based on parameters of the well configuration. The parameters of the well configuration may include a width of a tubing 120 disposed in the wellbore 102 or a size of the ESP 100. In embodiments, the threshold may be determined based on a model, which may be a machine learning model. The threshold may also be set based on empirical data of ESP size and corresponding thresholds. The empirical data may be tabulated. The threshold may be based on a minimum mass of slug estimated to be capable of impairing operation of the ESP 100 or damaging the ESP 100. That way, the speed of the ESP 100 can be altered only when necessary to avoid damage or impairment of operation of the ESP 100 when the slug passes through it.

In some embodiments, the controller 300 can be configured to alter the operation of the ESP 100 by speeding up the ESP 100, in response to detecting that the parameter exceeds a first threshold (e.g., an impairment threshold) and the parameter is below a second threshold (e.g., a danger threshold). The first threshold may be based on a minimum mass of slug estimated to be capable of impairing operation of the ESP 100 (e.g., impairment of operation of the ESP 100 may be that the flow rate achieved by the ESP 100 falls below a desired flow rate). That is, when the slug is of a certain mass, the ESP 100 may not be capable of pumping the fluid at its required flow rate. In some embodiments, the first threshold may be based on additional or other factors such as the size of the ESP 100, the type of the ESP 100, the size of the well, the type of slug, the volume of the slug, or parameters of the well configuration. Different first thresholds may be used depending on the situation. For example, if the slug is determined to be a sand slug, the first threshold may be different than if the slug is determined to be a gas slug. This parameter and/or the threshold may be determined based on historical data or one or more models. The model may be a machine learning model. The second threshold (e.g., a danger threshold) may be based on a minimum mass of slug estimated to be capable of damaging the ESP 100. That is, it may be known that a slug of a certain size is likely to damage the ESP 100 when the slug travels through the ESP 100 while the ESP 100 is running at a certain speed, and the second threshold is set on that basis. In some embodiments, the second threshold may be based on additional or other factors such as the size of the ESP 100, the type of the ESP 100, the size of the well, the type of slug, the volume of the slug, or the well configuration. Different second thresholds may be used depending on the situation. For example, if the slug is determined to be a sand slug, second threshold may be different than if the slug is determined to be a gas slug. This second threshold may be determined based on historical data or one or more models. The model may be a machine learning model. The altering of the operation of the ESP 100 by speeding up the ESP 100 in response to detecting that the parameter exceeds the threshold and the parameter is below a second threshold has the advantage in that when the slug is below a certain mass, no change to the ESP 100 is needed, and when the slug is above the mass that would reduce performance of the ESP 100, the power to the ESP 100 is increased to avoid the reduction in performance. However, speeding up the ESP 100 when the slug is of a mass that is capable of damaging the ESP 100 would not be ideal. Thus, the second threshold prevents such a speedup when the mass is such that the ESP 100 would be damaged if the slug were to pass through while the ESP 100 is running normal speed or at a higher speed. Thus, the speeding up of the ESP 100 may prevent or mitigate a drop in production rate of the fluid (e.g., oil or hydrocarbons) in certain situations involving slugs.

In some embodiments, the end 214 of the fiber optic cable 206 is disposed a distance downhole of the ESP 100, and the distance is an effective distance to provide advanced warning of the gas slug or the sand slug. This enables the controller 300 alter the operation of the ESP 100 at a time that is set based on an estimated position of the slug and an estimated velocity of the slug. The position of the slug and the velocity of the slug may be estimated using the DAS system 200. The time may be sufficiently advanced for the alteration of the operation of the ESP 100 to occur prior to arrival of the slug at the ESP 100. The time that is set by the controller 300 may be based on an estimated time of arrival of the slug at the ESP 100. The time that is set by the controller 300 may be less than or equal to the estimated time of arrival of the slug at the ESP 100.

Figure 4:
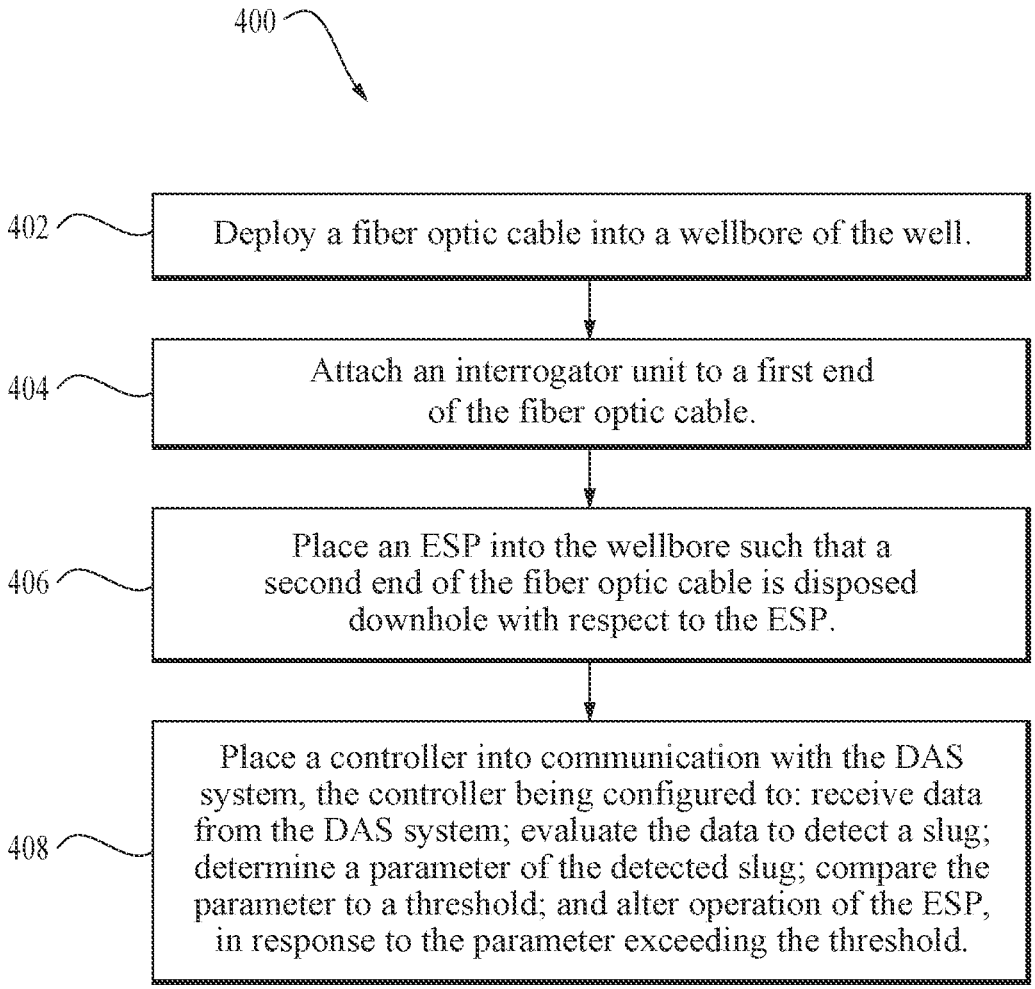
FIG. 4 is a flowchart of an exemplary method of installing a system for producing fluid from a well, according to an embodiment.

FIG. 4 shows an exemplary method 400 of installing a system for producing fluid from a well according to an embodiment. Referring to FIGS. 3A, 3B, and 4, steps 402 and 404 of the method involve installing the DAS system 200. In step 402, the fiber optic cable 206 is deployed into the wellbore 102 of the well. The fiber optic cable 206 may be deployed by launching a torpedo with a spool of the fiber optic cable 206 into the wellbore 102. In some embodiments, the installation of the fiber optic cable 206 is part of the completion of the well and is permanently set in place. For example, the fiber optic cable 206 may be cemented in with the casing 104. In step 404, the interrogator unit 204 is attached to a first (e.g. proximal) end 216 of the fiber optic cable 206. Step 406 includes placing the electrical submersible pump ESP 100 into the wellbore 102 such that a second (e.g. distal) end 214 of the fiber optic cable 206 is disposed downhole with respect to the ESP 100. Step 408 includes installing a controller 300 such that the controller 300 is in communication with the DAS system 200. In embodiments, the controller 300 may be any controller embodiment described herein. For example, the controller 300 may be configured to: receive data from the DAS system 200; process the data to detect a slug; determine a parameter of the detected slug; and alter operation of the ESP 100, in response to determining that the parameter exceeds a threshold. The parameter may include a depth range of the slug, a tension in the fiber optic cable 206, a magnitude of an acoustic signal received by the fiber optic cable 206, an estimated length of the slug, an estimated volume of the slug, or an estimated mass of the slug. The parameter may include a severity rating based on at least one of a position of the slug, a velocity of the slug, a length of the slug, a volume of the slug, and a mass of the slug. The mass of the slug may be estimated based on a measured depth range of the slug, a tension in the fiber optic cable, and/or a magnitude of acoustic signal received by the fiber optic cable 206. The slug may be a gas slug or a sand slug in the fluid. The alteration of the operation of the ESP 100 may include stopping the ESP 100 or bringing the ESP 100 to an idle state. The method 400 may include configuring the system according to any of the embodiments disclosed herein, which will not be repeated here in the interest of conciseness.

Figure 5:
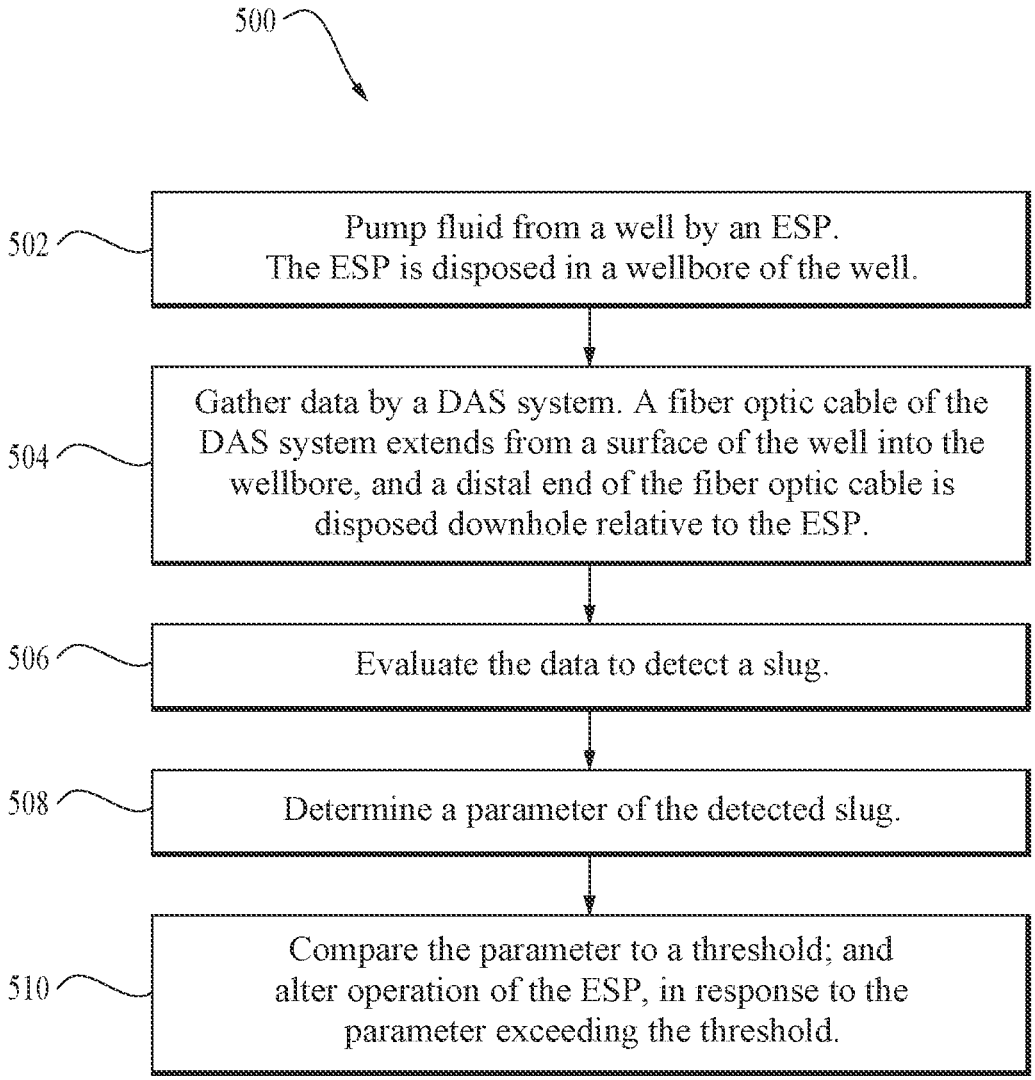
FIG. 5 is a flowchart of an exemplary method of producing fluid from a well, according to an embodiment.

Referring to FIG. 5, a method 500 of producing fluid from a well is provided. Step 502 includes pumping the fluid by the ESP 100. The ESP 100 is disposed in the wellbore 102 of the well. Step 504 includes gathering data by a distributed acoustic sensing (DAS) system 200. A fiber optic cable 206 of the DAS system 200 extends along the wellbore 102, and an end (e.g. the distal end) 214 of the fiber optic cable 206 is disposed downhole relative to the ESP 100. Step 506 includes processing the data to detect a slug. Step 508 includes determining a parameter of the detected slug. Step 510 includes altering operation of the ESP 100, for example in response to determining that the parameter exceeds a threshold. The parameter may include a depth range of the slug, a tension in the fiber optic cable 206, a magnitude of an acoustic signal received by the fiber optic cable 206, an estimated length of the slug, an estimated volume of the slug, or an estimated mass of the slug. The parameter may include a severity rating based on a position of the slug, a velocity of the slug, a length of the slug, a volume of the slug, a mass of the slug, and/or combinations thereof. The mass of the slug may be estimated based on a measured depth range of the slug, a tension in the fiber optic cable 206, a magnitude of acoustic signal received by the fiber optic cable 206, and/or combinations thereof. The slug may be a gas slug or a sand slug in the fluid. The alteration of the operation of the ESP 100 may include stopping the ESP 100 or bringing the ESP 100 to an idle state. The method 500 may include any operation according to any of the embodiments disclosed herein, which will not be repeated here in the interest of conciseness.

Figure 7:
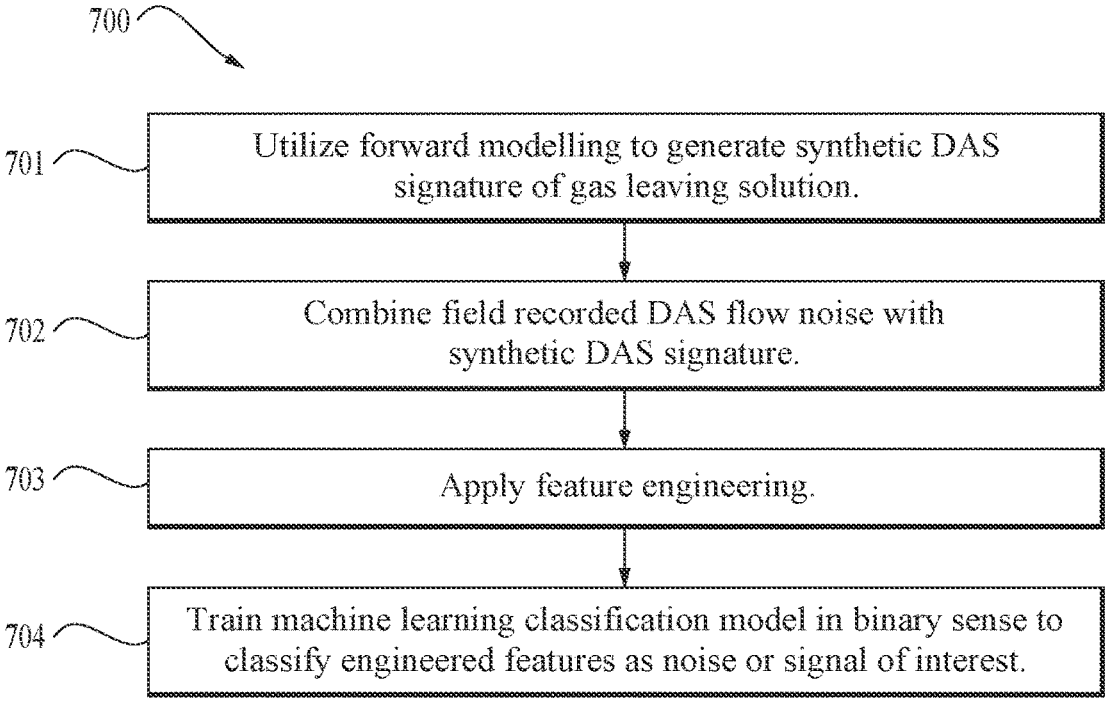
FIG. 7 is a flowchart of an exemplary method of supervised learning model training.

Referring to FIG. 7, an exemplary supervised method 700 of training a model to classify slugs in a well having an ESP and a DAS system is shown. In some embodiments, the model may be trained on data from one or more wells, and the model may be able to classify slugs in the one or more wells and/or other wells. In some embodiments, the model may be trained to determine whether a slug detected by the DAS system disposed in the well is capable of affecting performance of the ESP in the well. In some embodiments, the model may be applied to non-DAS data such as data from a temperature or pressure sensor to determine whether the slug is capable of affecting performance of the ESP in the well. Determining whether the slug is capable of affecting performance of the ESP can be advantageous because based on this information, a decision can be made whether to slow down, idle, or stop the ESP to avoid damage to the ESP.

In step 701, the method 700 may include using forward modeling to generate a synthetic DAS signature of gas leaving solution in the well. This may include generating the synthetic DAS signature by modeling slugs in the well using a computer/processor. Generating the synthetic DAS signature may include using a physics-based model to simulate a DAS signal in the field. Using forward modeling instead of data from physical wells may be advantageous because in some instances there may not be enough recorded data from physical wells available to adequately train the model. DAS systems can be expensive and not every well may have a DAS system.

The forward modeling may involve creating a computational model to predict how the fiber optic cable will respond to different acoustic sources or disturbances in its environment. It may include modeling the well and simulating acoustic interactions in the well. For example, a simulated slug in the well may generate acoustic waves, and those acoustic waves may propagate through the well and interact with the fiber optic cable. The forward modeling may also include modeling the DAS response, such as simulating the backscattering process of light within the fiber optic cable as it is affected by acoustic vibrations. The model may account for the principles of Rayleigh scattering, the sensitivity of the fiber to different types of vibrations, and the spatial resolution of the DAS system. Alternatively or in addition, DAS recordings from one or more physical wells may be used (for example, to tune the forward modeling to produce more realistic outputs). The synthetic DAS signature may be a unique pattern or set of characteristics observed in the data collected by the DAS system (e.g., patterns and/or characteristics of slugs). The forward modeling may use a physics-based model which returns what the signature of the slug would look like in the field. The output of the physics-based model may be compared with historical data to confirm accuracy and/or to revise the model.

The method 700 may further include receiving flow noise recorded from a DAS system in the field (e.g. in a well). In step 702, the method 700 may include combining the field-recorded DAS flow noise and the synthetic DAS signature to generate data. This may be advantageous because adding the noise may improve robustness and generalization ability of the model. It may make the signal more realistic. In embodiments, the field-recorded flow noise may be recorded from steady state production in the well without any slug (or without any slug capable of affecting ESP performance). Noise from one well or a variety of wells may be used.

Figure 6:
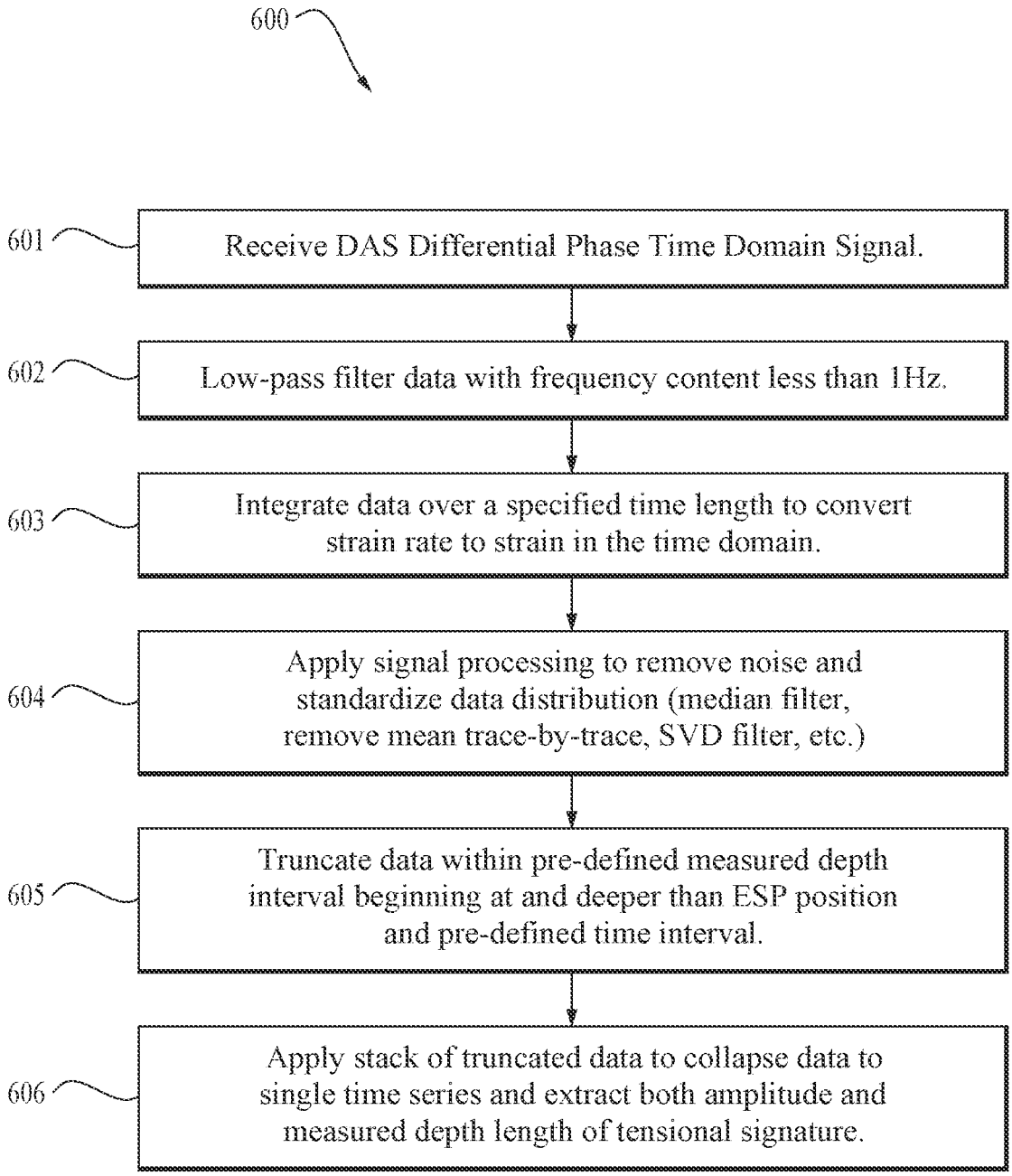
FIG. 6 is a flowchart of an exemplary method of a feature engineering workflow.

The method 700 may further include step 703, which may include applying feature engineering to the data. Feature engineering the data may involve creation, selection, and transformation of raw data into features that may improve accuracy or performance of the machine learning. Referring to FIG. 6, the method 600 of feature engineering may include, at step 601, receiving a DAS differential phase time domain signal (e.g., receiving a differential phase time domain signal of the combined DAS flow noise and DAS signature).

At step 602, the method 600 may include low-pass filtering data with a frequency less than 1 Hz (e.g., low-pass filtering the signal from step 601). That is, frequencies above approximately 1 Hz may be eliminated. As gas comes out of solution, thermal effects in the lower frequencies can be seen, so embodiments may focus on those low frequencies which relate to slug detection. The movement of the slug may be translated into a tensional signature (e.g., positive bulge in terms of amplitude). The positive bulge of amplitude and/or duration in time of the spike may be detected. At step 603, the method 600 may include integrating the data over a specified time length to convert strain rate to strain in the time domain (e.g., integrating the signal over a time length to convert strain rate of the signal to strain data in a time domain). In some embodiments, the time length is approximately 10 seconds. In some embodiments, the time length could depend on the diameter of the well and/or other metrics.

At step 604, the method may include applying signal processing to remove noise and standardize data distribution (e.g., applying signal processing to the signal/data and/or removing noise from the strain data and standardizing the strain data). Techniques used to accomplish this may include median filtering, removing trace-by-trace, SVD filtering, 2D filtering, and/or any other suitable method. At step 605, the method may include truncating the strain data at a depth interval and a time interval. The data may be truncated at depths near the ESP (either where the ESP is in the model or where the ESP would be positioned in the model if absent). In some embodiments, the depth interval is entirely below (e.g., downhole of) the ESP. That is, data from depths above the ESP may be eliminated. In some embodiments, the depth interval spans from above the ESP to below the ESP. The time interval may be a time interval of when the slug is coming out of solution and/or ascending up the well.

The method 600 may further include, at step 606, applying a stack of truncated data to collapse the data to a single time series and extracting both amplitude and measured depth length of a tensional signature (e.g., collapsing the truncated strain data to a single time series, and extracting amplitude and depth length of a tensional signature from the truncated strain data). This may include, for example, taking a sum over measured depth to stack the data into the single time series. This may be input into the machine learning model. Dimensionality may be reduced to the single time series. In more detail, the DAS data may be 2 dimensional: it may have measured depth and time. A set number of measured depths about the ESP may be chosen at some point deeper than ESP (e.g., 100 ft of data for 1 hour). The stacking may include summing across all measured depths to create one measured depth at the same time duration. The 2D spatial-temporal representation may be converted to a single temporal relationship: depth over time (e.g., collapsed into a single depth 1D curve).

Referring again to FIG. 7, the feature engineering approach described above (e.g. with respect to FIG. 6) may be applied to the data from step 702. The method may further include, at step 704, training a machine learning classification model in the binary sense to classify engineering features as noise or as a signal of interest (e.g., training a machine learning model to classify slugs, based on the feature engineered data). Synthetics may be translated with respect to how much gas comes out of solution, width and size of the slug, and ESP size, which may influence the limit of gas slug that will cause damage to the ESP. The physics-based synthetic model may be tuned to be able to effectively provide a threshold of how large of a slug can be detrimental to ESP. There may be two sets of data. For example, there may be class 0 with synthetics with field noise and dangerous gas slugs, and class 1 data not having any activity dangerous to the ESP. In some embodiments, a neural network may be trained. For example, the neural network may be a convolutional neural network, multilayer perceptrons, a recurrent neural network, a long short-term memory network, a gated recurrent unit network, a sequence-to-sequence model, an attention mechanism and transformer, or any other type of suitable network or combinations of networks.

Once trained, the model may be used to determine whether there is a slug that will present an issue to the ESP. The classification may involve a threshold regarding the slug affecting performance of the ESP (e.g., regarding whether the slug will damage to the ESP). One or more thresholds may be used to determine whether and how to change the ESP (e.g. to avoid damage from a slug). The classification may be used on data gathered during production in a physical well, for example allowing evaluation/classification of real-world DAS data in a well. For example, an operation of the ESP in the physical well may be changed, in response to classifying a slug in the physical well as capable of affecting performance of the ESP. The operation of the ESP may be changed by a controller, in response to the controller classifying the slug in the physical well as capable of affecting performance of the ESP, using the machine learning model. In some embodiments where the classification is binary, the ESP may be slowed down, idled, or stopped in response to the model detecting that a slug is capable of damaging the ESP. In some embodiments where the classification is nonbinary, the ESP may be sped up in response to detecting that a slug is big enough to decrease flow rate of through the pump but small enough not to cause damage, and the ESP may be slowed down, idled, or stopped in response to the model detecting that a slug is capable of damaging the ESP. Speeding up the ESP may prevent the drop in flow rate. Additional data from one or more wells may be collected and used to verify or update the model.

Figure 8:
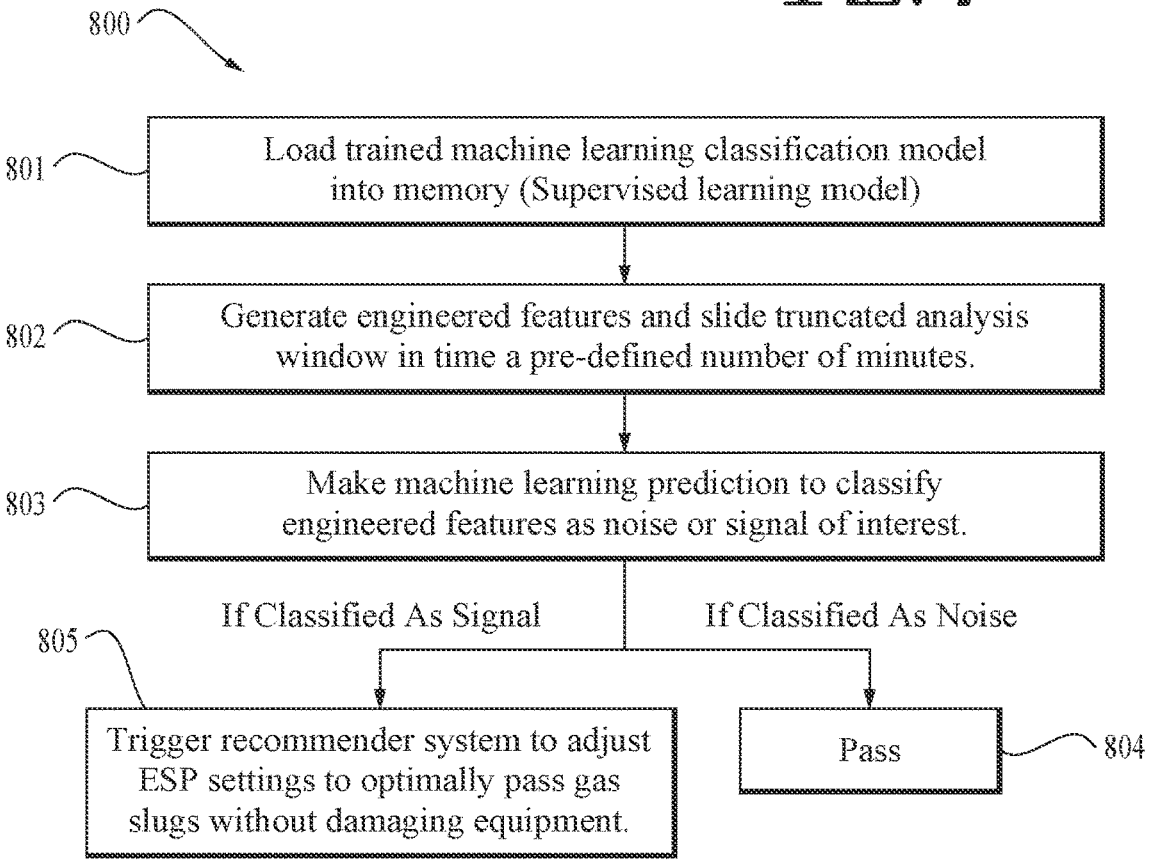
FIG. 8 is a flowchart of an exemplary method of supervised learning model inference.

Referring to FIG. 8, an exemplary method 800 of pumping a fluid from a well using a supervised machine learning model is shown. The method may include the step 801 of loading a trained machine learning classification model into memory. In some embodiments, the machine learning model is the model that was trained according to the method 700 shown in FIG. 7.

At step 802, the method 800 may include generating engineering features and sliding a truncated analysis window in time a pre-defined number of minutes (e.g., receiving data from a DAS in the well and feature engineering the data to generate an engineering feature). The generation of the engineering feature may be performed according to the method 600 of FIG. 6. For example, the feature engineering may include applying a low-pass filter to a differential phase time domain signal from the DAS; integrating the signal over a time length to convert strain rate of the signal to strain data in a time domain; removing noise from the strain data, and standardizing the strain data; truncating the strain data at a depth interval and a time interval; and collapsing the truncated strain data to a single time series, and extracting amplitude and measured depth length of a tensional signature from the truncated strain data.

At step 803, the method may include making a machine learning prediction to classify the engineering feature as noise or a signal of interest (e.g., classifying the engineering feature using a machine learning model (e.g. using a threshold)). The machine learning prediction may be made by the machine learning model that was trained according to the method 700 of FIG. 7. If an engineered feature is classified as noise, it may mean that either there are no slugs or there are one or more slugs that are too small to be registered as a capable of affecting performance of the ESP. If the engineering feature is classified as a signal of interest, it may mean that there is a slug that is capable of affecting performance of the ESP.

In step 804, if the engineering feature is classified as noise, it passes (e.g. in response to classifying an engineering feature as not being a slug capable of affecting performance of the ESP, maintaining a current speed of the ESP). For example, if the engineering feature were classified as noise, and the ESP was running at normal speed, the controller would take no action to change the speed of the ESP, because there would be no detectable threat to the ESP or its performance.

At step 805, if the engineering feature is instead classified as a signal, a recommender system is triggered to adjust ESP settings to optimally pass gas slugs without damaging equipment (e.g., in response to classifying the engineering feature as a slug capable of affecting performance of the ESP in the well, changing an operation of the ESP in the well). For example, the recommender system may be configured to display a recommendation via one or more output device, with the recommendation being used by one or more user/ personnel to determine action. In some embodiments, the recommender system is absent and the ESP is simply stopped or brought to idle (e.g. automatically, for example by computer/processor) whenever there is a classification as a signal. The ESP would be stopped or brought to idle before arrival of the slug at the ESP and restarted after the slug passed the ESP. In some embodiments, the recommender system assesses the strength of the signal to determine what action should be taken. The recommender system may use the one or two thresholds according to the embodiments described herein. There may be even more than two thresholds depending on the application. In some embodiments, the classifying of the engineering feature may include classifying the engineering feature by a controller using the machine learning model. In some embodiments, the changing of the operation of the ESP includes slowing down the ESP, idling the ESP, or stopping the ESP by the controller, in response to the controller classifying the engineering feature as the slug capable of affecting performance of the ESP.

In some embodiments, instead of there being only two classifications leading to either step 804 or step 805, there may be three or more classifications. For example, in some embodiments, there may be separate classifications for no slug, sand slug, and gas slug, each having their own branches. For example, different recommender systems may be used depending on whether the slug is classified as a sand slug or a gas slug. In some embodiments, the recommender systems involve looking at the signal in a regression sense to understand the strength of the signal. In some embodiments, non-machine learning classification models may be used in the recommender system, for example, in situations in which the data is linear. In some embodiments, a physics-based model or a hybrid learning/physics-based model may be used in the recommender system, for example, in situations in which the data is non-linear. In some embodiments, the changing of the operation of the ESP comprises recommending a change for consideration and/or implementation by user, or automatically, by computer, changing the operation of the ESP. In some embodiments, the changing of the operation of the ESP is implemented by a different controller or processor than the controller or processor that uses the machine learning model for the classification. In some embodiments, the same controller or processor both classifies the slugs and changes the operation of the ESP.

Figure 9:
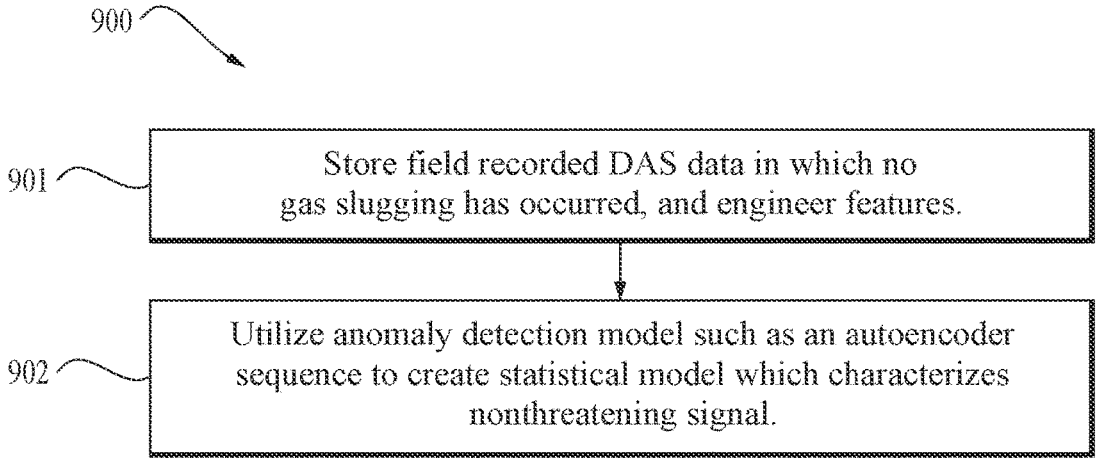
FIG. 9 is a flowchart of an exemplary method of unsupervised learning model training.

Referring to FIG. 9, an exemplary method 900 of training an unsupervised model to classify slugs is provided. In some embodiments, the model may be trained on data from one or more wells, and the model is able to classify slugs in other wells. Data recorded during production times that include no slugs that are threats to the ESP may be used to build a safe profile. This may be used to create signatures to define how anomalous new data is. In some embodiments, the model may be trained to determine whether a slug detected by a DAS system disposed in a well is capable of affecting performance of an ESP in the well. In some embodiments, the model may be applied to non-DAS data such as data from a temperature or pressure sensor to determine whether the slug is capable of affecting performance of the ESP in the well. Determining whether the slug is capable of affecting performance of the ESP can be advantageous because based on this information, a decision can be made whether to slow down, idle, or stop the ESP to avoid damage to the ESP.

At step 901, the method may include storing field recorded DAS data in which no gas slugging has occurred (collecting data from a DAS in a well at a time period in which no slug affects performance of an ESP in the well), and engineering features (e.g., feature engineering the data). Engineering the features may be performed according to the method 600 of FIG. 6. For example, engineering the features may include receiving a differential phase time domain signal from the DAS; low-pass filtering the signal; integrating the signal over a time length to convert strain rate of the signal to strain data in a time domain; removing noise from the strain data, and standardizing the strain data; truncating the strain data at a depth interval and a time interval; and collapsing the truncated strain data to a single time series, and extracting amplitude and measured depth length of a tensional signature from the truncated strain data.

At step 902, the method may include utilizing an anomaly detection model such as an autoencoder to create a statistical model which characterizes nonthreatening signal (e.g., training a machine learning model to classify slugs, based on the feature engineered data, using an anomaly detection model). For example, the anomaly detection model may use an encoder/decoder sequence. The anomaly detection model may be an autoencoder (e.g., convolutional autoencoder), isolation forest, local outlier factor, one-class SVM, LSTM network, or any other model or combination of models. If an autoencoder is used, the autoencoder may produce a number of convolutions and down sample them into a condensed representation (e.g., latent space). The model may then build the data up to its original shape. The model may seek to understand how to reproduce the initial input by using convolutions without the input data having been classified.

In more detail, an encoder/decoder sequence may be used to classify engineered features as capable of affecting performance of an ESP or not capable of affecting performance of an ESP. The encoder may compress the input features into a lower-dimensional latent representation, capturing the essence of the data while reducing its dimensionality. This may involve a neural network structure with layers that progressively decrease in size. The decoder may reconstruct the input data from its latent representation. A high fidelity may be achieved between the original input features and their reconstructed versions, minimizing the reconstruction error. A loss function, such as Mean Squared Error (MSE), may be used to quantify the difference between original and reconstructed data, and adjust the model weights to minimize this error during training. After training, a threshold may be determined for the reconstruction error by evaluating the model on a validation set of normal conditions. Errors above this threshold indicate deviations from normalcy. The model's effectiveness may be tested using a separate test set that includes known examples of both normal and dangerous conditions. Performance metrics suitable for classification tasks, such as accuracy, precision, recall, and F1 score, may be used. The model may be iteratively refined by adjusting the architecture, re-tuning parameters, or improving the feature engineering process.

In some embodiments, the model is trained to determine a profile/threshold indictive of damage to ESP, for example based on the degree of anomaly of data from standard. Data may continue to be collected and used to update the model (e.g. during production). In some embodiments, the machine learning model may be used to classify slugs in another well (e.g., a physical well). In some embodiments, an operation of another ESP may be changed, in response to classifying a slug in the other well as capable of affecting performance of the other ESP based on the model. The other well may be a well having a DAS system installed. The operation of the other ESP may be changed by a controller, in response to the controller classifying the slug in the other well as capable of affecting performance of the other ESP, using the machine learning model. In some embodiments, both supervised and non-supervised models may be used to determine recommendation/automatic action (e.g. comparing both, evaluating both based on real world data to determine weighting or which is better).

Figure 10:
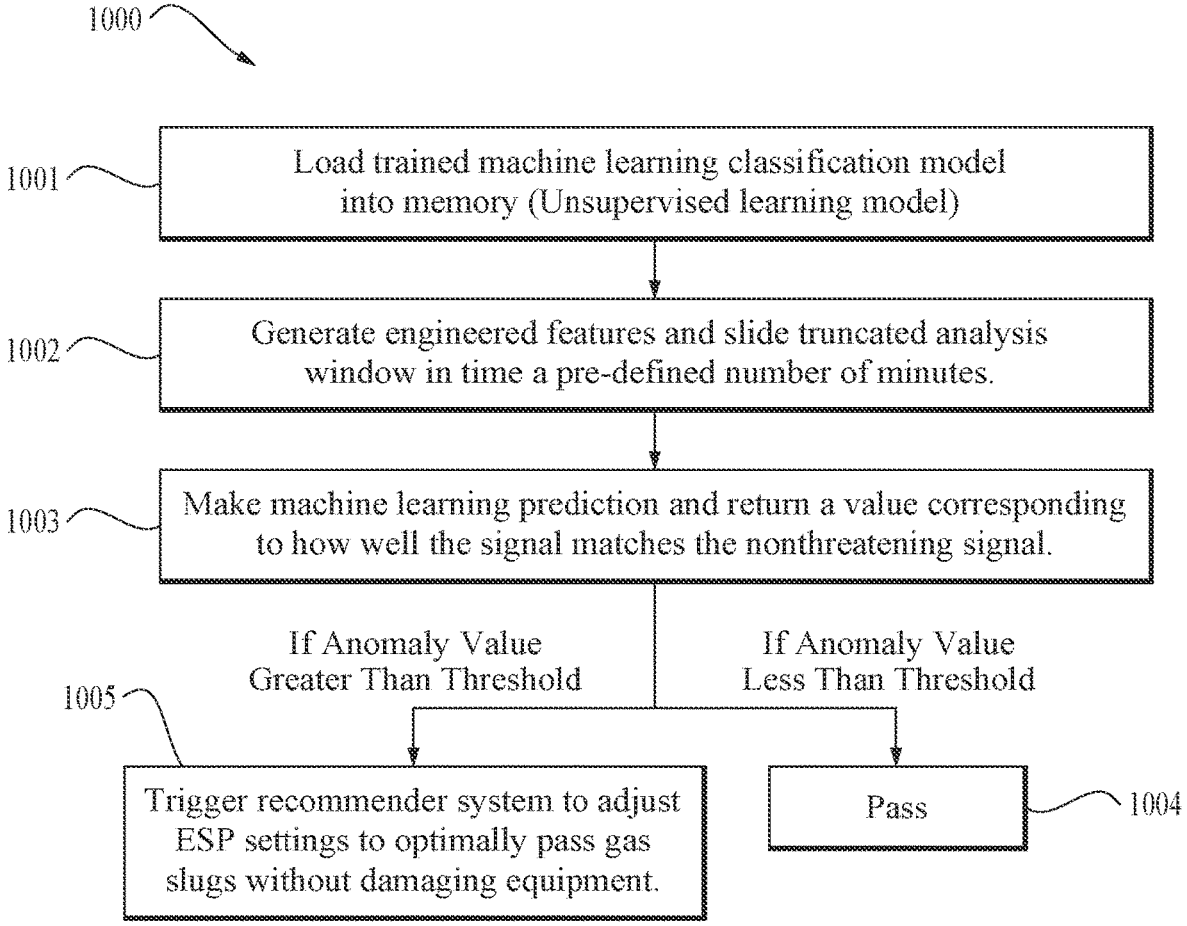
FIG. 10 is a flowchart of an exemplary method of unsupervised learning model inference.

Referring to FIG. 10, a method 1000 of pumping fluid from a well using an unsupervised machine learning model is shown. The method may include step 1001 of loading the trained machine learning classification model into memory. In some embodiments, the machine learning model is the model that was trained according to the method 900 of FIG. 9.

At step 1002, the method 1000 may include generating engineering features and sliding a truncated analysis window in time at a pre-defined number of minutes (e.g., receiving data from a DAS in the well and feature engineering the data to generate an engineering feature). The generation of the engineering feature may be performed according to the method 600 of FIG. 6. For example, the feature engineering may include applying a low-pass filter to a differential phase time domain signal from the DAS; integrating the signal over a time length to convert strain rate of the signal to strain data in the time domain; removing noise from the strain data, and standardizing the strain data; truncating the strain data at a depth interval and a time interval; and collapsing the truncated strain data to a single time series, and extracting amplitude and measured depth length of a tensional signature from the truncated strain data.

In step 1003, the method may include making a machine learning prediction and returning a value corresponding to how well the signal matches the nonthreatening signal (e.g., outputting an anomaly estimation factor, using a machine learning model, based on the engineering feature). The anomaly estimation factor may indicate the severity of the slug. For example, engineering features with large slugs would tend to cause high values to be returned for the anomaly estimation factor because they do not match the nonthreatening signal (e.g. the degree of anomaly from standard and/or from the approved profile may be greater than a threshold amount, which may be indicative of damage to the ESP). Engineering features with small slugs or no slugs would tend to cause low values to be returned for the anomaly estimation factor because they more closely match the nonthreatening signal (e.g. the degree of anomaly from standard and/or from the approved profile may be less than a threshold amount, which may be indicative of potential damage to be caused to the ESP). In embodiments, the threshold amount (e.g. difference form the norm) representative of a slug potentially causing a performance issue with the ESP may be pre-set, for example based on the model and/or real-world observations.

In step 1004, according to an embodiment, if the engineering feature is classified as noise, it passes (e.g., in response to the anomaly estimation factor associated with the engineering feature not exceeding the threshold, not changing an operation of the ESP). For example, if the engineering feature were classified as noise, and the ESP was running at normal speed, the controller would take no action to change the speed of the ESP, because there would be no detectable threat to the ESP or its performance. At Step 1005, according to an embodiment, if the engineering feature is instead classified as a signal, a recommender system is triggered to adjust ESP settings to optimally pass gas slugs without damaging equipment (e.g., in response to the anomaly estimation factor exceeding a threshold, changing an operation of the ESP in the well). In some embodiments, the recommender system is absent and the ESP is simply stopped or brought to idle whenever there is a classification as a signal. The ESP would be stopped or brought to idle before arrival of the slug at the ESP and restarted after the slug passed the ESP. In some embodiments, the recommender system assesses the strength of the signal to determine what action should be taken. The recommender system may use the one or two thresholds according to the embodiments described herein. In some embodiments, classifying the engineering features may include classifying the engineering features by a controller using the machine learning model. In some embodiments, the changing of the operation of the ESP includes slowing down the ESP or stopping the ESP by a controller, in response to the controller determining that the anomaly estimation factor exceeds the threshold. There may be even more than two thresholds depending on the applications.

In some embodiments, instead of there being only two classifications leading to either step 1004 or step 1005, there may be three or more classifications. For example, in some embodiments, there may be separate classifications for no slug, sand slug, and gas slug, each having their own branches. For example, different recommender systems may be used depending on whether the slug is classified as a sand slug or a gas slug. In some embodiments, the recommender systems involves looking at the signal in a regression sense to understand the strength of the signal. In some embodiments, non-machine learning classification models may be used in the recommender system, for example, in situations in which the data is linear. In some embodiments, a physics-based model or a hybrid learning/physics-based model may be used in the recommender system, for example, in situations in which the data is non-linear.

In some embodiments, the changing of the operation of the ESP comprises recommending a change for consideration and/or implementation by user, or automatically, by computer, changing the operation of the ESP. In some embodiments, the changing of the operation of the ESP is implemented by a different controller or processor than the controller or processor that uses the machine learning model for the classification. In some embodiments, the same controller or processor both classifies the slugs and changes the operation of the ESP. In some embodiments, the model may be recalibrated. For example, additional data may be collected and the model may be updated to recalibrate model. The recalibrated model may then be used to evaluate new data. In some embodiments, the method 1000 includes an iterative process of collecting data, recalibrating the model based on data, and applying the recalibrated model. The anomaly threshold may be tuned over time as familiarity is gained with the well system. The anomaly threshold may be tuned based on whether the threshold is high enough to generate an alert when slugs capable of affecting performance of the ESP (e.g., dangerous slugs) come up the well.

In some embodiments, a method of operating an ESP in a well to pump fluid includes training a model to detect potentially damaging slugs in the well; receiving data from a DAS and/or one or more other sensors monitoring well conditions; using the trained model to evaluate the data in real time; and based on the evaluation, determining an action for the ESP. The method may further include iteratively collecting data, recalibrating the model based on the data, and applying the recalibrated model to evaluate data in real time. In some embodiments, the model may be a supervised model (e.g. such as that described with respect to FIG. 7) or unsupervised model (e.g. such as that described with respect to FIG. 9). Using the trained model to evaluate data may be similar to the approach of FIG. 8 (for example for a supervised model) or FIG. 10 (for example for an unsupervised model).

The methods of FIGS. 6-10 and related methods disclosed herein may improve the functioning of a computer by allowing the computer to more quickly and accurately classify slugs as compared with the conventional art. These methods may improve the technical field of hydrocarbon production because, through these more accurate methods of classifying slugs and more effective methods of controlling ESPs based on the classification, oil or other hydrocarbons may be produced more consistently and economically. For example, by slowing down, stopping, and/or speeding up the ESP based on the size of slugs coming up the well, downtime (due to a damaged ESP and/or slugs interfering with flow) may be reduced and hydrocarbon production may be more consistent.

Embodiments of the present disclosure may also provide the advantage of improving ESP run life and/or improving overall production of the well by reducing unnecessary down time.

ADDITIONAL DISCLOSURE

The following are non-limiting, specific embodiments in accordance with the present disclosure:

In a first embodiment, a system for producing a fluid from a well including an electrical submersible pump (ESP) disposed in a wellbore of the well and configured to pump the fluid; a distributed acoustic sensing (DAS) system comprising an interrogator unit, and a fiber optic cable extending downhole (e.g. from the surface of the well) and/or along the wellbore, an end (e.g. the distal end) of the fiber optic cable being disposed downhole relative to the ESP; a controller configured to: receive data from the DAS system (e.g. the processor and/or the receiver); process or evaluate the data to detect a slug; determine a parameter of the detected slug; and alter operation of the ESP, in response to determining that the parameter exceeds a threshold (e.g. comparing the parameter to a (e.g. pre-set) threshold (which in some embodiments may be based on damage to the ESP) and altering operation of the ESP responsive to the parameter exceeding the threshold).

A second embodiment can include the system of the first embodiment wherein the ESP is configured to pump the fluid in an uphole direction (e.g. to the surface) to produce the fluid from the well.

A third embodiment can include the system of any of the first and second embodiments, wherein the interrogator unit includes a light source configured to emit coherent light into the fiber optic cable, and a receiver configured to receive backscattered light from the fiber optic cable.

A fourth embodiment can include the system of any of the first through the third embodiments, wherein the DAS further includes a processor configured to generate the data based on the backscattered light (e.g. signal received from the receiver), and send the generated data to the controller.

A fifth embodiment can include the system of any of the first through the fourth embodiments, wherein the slug is detected based on a measured depth range of the slug and/or a tension in the fiber optic cable.

A sixth embodiment can include the system of any of the first through the fifth embodiments, wherein the parameter includes a depth range of the slug, a tension in the fiber optic cable, a magnitude of an acoustic signal received by the fiber optic cable, an estimated length of the slug, an estimated volume of the slug, and/or an estimated mass of the slug.

A seventh embodiment can include the system of any of the first through sixth embodiments, wherein the parameter includes a severity rating based on a position of the slug, a velocity of the slug, a length of the slug, a volume of the slug, and/or a mass of the slug.

An eight embodiment can include the system of any of the first through seventh embodiments, wherein the parameter includes a mass of the slug, and the mass of the slug is estimated based on a measured depth range of the slug, a tension in the fiber optic cable, and/or a magnitude of acoustic signal received by the fiber optic cable.

A ninth embodiment can include the system of any of the first through eight embodiments, wherein the slug is a gas slug or a sand slug in the fluid.

A tenth embodiment can include the system of any of the first through ninth embodiments, wherein the alteration of the operation of the ESP comprises stopping the ESP or bringing the ESP to an idle state.

An eleventh embodiment can include the system of any of the first through tenth embodiments, wherein the stopping of the ESP or the bringing of the ESP to the idle state prevents or mitigates (e.g. reduces) damages to the ESP as a result of the slug passing through the ESP (e.g., slows the flow rate of the slug through the ESP, for example to a level unlikely to damage the ESP).

A twelfth embodiment can include the system of any of the first through eleventh embodiments, wherein the controller is further configured to alter the operation of the ESP by speeding up the ESP, in response to detecting that the parameter exceeds the threshold and the parameter is below another threshold.

A thirteenth embodiment can include the system of any of the first through twelfth embodiments, wherein the threshold is based on a minimum mass of slug estimated to be capable of impairing operation of the ESP, and the other threshold is based on a minimum mass of slug estimated to be capable of damaging the ESP.

A fourteenth embodiment can include the system of any of the first through thirteenth embodiments, wherein the speeding up of the ESP prevents or mitigates a drop in production rate of the fluid.

A fifteenth embodiment can include the system of any of the first through fourteenth embodiments, wherein the fluid is oil.

A sixteenth embodiment can include the system of any of the first through fifteenth embodiments, wherein the fluid is liquid hydrocarbons.

A seventeenth embodiment can include the system of any of the first through sixteenth embodiments, wherein the fiber optic cable is disposed a distance downhole of the ESP, and the distance is an effective distance to provide advanced warning of the gas slug or the sand slug.

An eighteenth embodiment can include the system of any of the first through seventeenth embodiments, wherein the threshold is based on parameters of the well configuration.

A nineteenth embodiment, which is the system of any of the first through eighteenth embodiments, wherein the threshold is determined based on a model.

A twentieth embodiment, which is the system of any one of the first through eighteenth embodiments, wherein the threshold is determined based on a plurality of models.

A twenty-first embodiment can include the system of any of the first through twentieth embodiments, wherein the severity rating is determined based on a model.

A twenty-second embodiment can include the system of any of the first through twenty-first embodiments, wherein the model is a machine learning model.

A twenty-third embodiment can include the system of any of the first through twenty-second embodiments, wherein the threshold is based on a minimum mass of slug estimated to be capable of impairing operation of the ESP or damaging the ESP.

A twenty-fourth embodiment can include the system of any of the first through twenty-third embodiments, wherein the parameters of the well configuration comprise width of a tubing disposed in the wellbore.

A twenty-fifth embodiment can include the system of any of the first through twenty-fourth embodiments, wherein the parameters of the well configuration comprise a size of the ESP.

A twenty-sixth embodiment can include the system of any of the first through twenty-fifth embodiments, wherein the ESP is disposed in a vertical section of the well.

A twenty-seventh embodiment can include the system of any of the first through twenty-sixth embodiments, wherein the ESP is disposed in a horizontal section of the well.

A twenty-eighth embodiment can include the system of any of the first through twenty-seventh embodiments, wherein the controller is further configured to alter the operation of the ESP at a time that is set based on an estimated position of the slug and an estimated velocity of the slug.

A twenty-ninth embodiment can include the system of any of the first through twenty-eighth embodiments, wherein the time is sufficiently advanced for the alteration of the operation of the ESP to occur prior to arrival of the slug at the ESP.

A thirtieth embodiment can include the system of any of the first through twenty-ninth embodiments, wherein the position of the slug and the velocity of the slug are estimated using the DAS system.

A thirty-first embodiment can include the system of any of the first through thirtieth embodiments, wherein the controller is further configured to alter the operation of the ESP at a time that is set based on an estimated time of arrival of the slug at the ESP.

A thirty-second embodiment can include the system of any of the first through thirty-first embodiments, wherein the set time is less than the estimated time of arrival of the slug at the ESP.

A thirty-third embodiment can include the system of any of the first through thirty-second embodiments, wherein the fiber optic cable is disposed on tubing extending into the wellbore, in a groove in the tubing, inside the tubing, between the tubing and casing extending into the wellbore, in a groove in the casing, inside the casing, or outside of the casing.

A thirty-fourth embodiment can include the system of any of the first through thirty-third embodiments, wherein the parameter is based on an acoustic signal of less than 1 Hz (e.g. determining a parameter is based on analysis of the portion of the acoustic signal in a range less than approximately 1 Hz).

In a thirty-fifth embodiment, a method of installing a system for producing of fluid from a well including placing an electrical submersible pump (ESP) into a wellbore of the well, a second end of the fiber optic cable being disposed downhole with respect to the ESP; and communicatively coupling a controller with a distributed acoustic sensing (DAS) system comprising a fiber optic cable extending from a surface of the well down the wellbore, the controller being configured to: receive data from the DAS system; process the data to detect a slug; calculate a parameter of the detected slug; and alter operation of the ESP, in response to determining that the parameter exceeds a threshold.

A thirty-sixth embodiment can include the method of the first through thirty-fifth embodiment further comprising installing the DAS system.

A thirty-seventh embodiment can include the method of the first through thirty-sixth embodiment, wherein the installing of the DAS system comprises deploying a fiber optic cable into the wellbore such that a distal end of the fiber optic cable is downhole with respect to the ESP.

A thirty-eighth embodiment can include the method of the first through thirty-seventh embodiment, wherein the installing of the DAS system comprises attaching an interrogator unit to a proximal end of the DAS system.

In a thirty-ninth embodiment, a method of installing a system for producing of fluid from a well including installing a distributed acoustic sensing (DAS) system, which includes: deploying a fiber optic cable into a wellbore of the well; and attaching an interrogator unit to a first end of the fiber optic cable; placing an electrical submersible pump (ESP) into the wellbore, a second end of the fiber optic cable being disposed downhole with respect to the ESP; and communicatively coupling a controller such that the controller is in communication with the DAS system, the controller being configured to: receive data from the DAS system; process the data to detect a slug; calculate a parameter of the detected slug; and alter operation of the ESP, in response to determining that the parameter exceeds a threshold.

A fortieth embodiment can include the method of the first through thirty-ninth embodiments, wherein the parameter includes a depth range of the slug, a tension in the fiber optic cable, a magnitude of an acoustic signal received by the fiber optic cable, an estimated length of the slug, an estimated volume of the slug, and/or an estimated mass of the slug.

A forty-first embodiment can include the method of the first through fortieth embodiments, wherein the parameter includes a severity rating based on a position of the slug, a velocity of the slug, a length of the slug, a volume of the slug, and/or a mass of the slug.

A forty-second embodiment can include the method of the first through forty-first embodiments, wherein the parameter includes a mass of the slug.

A forty-third embodiment can include the method of any of the first through forty-second embodiments, wherein the mass of the slug is estimated based on a measured depth range of the slug.

A forty-third embodiment can include the method of any of the first through forty-third embodiments, wherein the mass of the slug is estimated based on a tension in the fiber optic cable.

A forty-fourth embodiment can include the method of any of the first through forty-third embodiments, wherein the mass of the slug is estimated based on a magnitude of acoustic signal received by the fiber optic cable.

A forty-fifth embodiment can include the method of any of the first through forty-fourth embodiments, wherein a volume of the slug is estimated based on depth range of the slug.

A forty-sixth embodiment can include the method of any of the first through forty-fifth embodiments, wherein a volume of the slug is estimated based on a tension in the fiber optic cable.

A forty-seventh embodiment can include the method of any of the first through forty-sixth embodiment, wherein a volume of the slug is estimated based on a magnitude of acoustic signal received by the fiber optic cable.

A forty-eighth embodiment can include the method of any of the first through forty-seventh embodiment, wherein the volume of the slug is estimated based on a depth range of the slug.

A forty-ninth embodiment can include the method of any of the first through forty-eighth embodiment, wherein the slug is a gas slug in the fluid.

A fiftieth embodiment can include the method of the first through forty-eighth embodiments, wherein the slug is a sand slug in the fluid.

A fifty-first embodiment can include the method of the first through fiftieth embodiments, wherein the alteration of the operation of the ESP includes stopping the ESP or bringing the ESP to an idle state.

In a fifty-second embodiment, a method of producing fluid from a well includes: pumping the fluid by an electrical submersible pump (ESP), the ESP being disposed in a wellbore of the well; gathering data by a distributed acoustic sensing (DAS) system, a fiber optic cable of the DAS system extending downhole in the wellbore, and an end (e.g. distal end) of the fiber optic cable being disposed downhole relative to the ESP; processing the data to detect a slug; determining a parameter of the detected slug; and altering operation of the ESP, in response to determining that the parameter exceeds a threshold (e.g. comparing the parameter to a (e.g. pre-set) threshold (which in some embodiments may be based on damage to the ESP) and altering operation of the ESP responsive to the parameter exceeding the threshold).

A fifty-third embodiment can include the method of the first through fifty-second embodiments, wherein the parameter comprises a depth range of the slug, a magnitude of an acoustic signal received by the fiber optic cable, an estimated length of the slug, an estimated volume of the slug, and/or an estimated mass of the slug.

A fifty-fourth embodiment can include the method of the first through fifty-third embodiments, wherein the parameter includes a severity rating based on a position of the slug, a velocity of the slug, a length of the slug, a volume of the slug, and/or a mass of the slug.

A fifty-fifth embodiment can include the method of the first through fifty-fourth embodiments, wherein the parameter includes a mass of the slug, and the mass of the slug is estimated based on a measured depth range of the slug, a tension in the fiber optic cable, and/or a magnitude of acoustic signal received by the fiber optic cable.

A fifty-sixth embodiment can include the method of the first through fifty-fifth embodiments, wherein the slug is a gas slug or a sand slug in the fluid.

A fifty-seventh embodiment includes the method of the first through the fifty-sixth embodiments, wherein the alteration of the operation of the ESP includes stopping the ESP or bringing the ESP to an idle state.

A fifty-eighth embodiment can include the method of the first through fifty-seventh embodiments, wherein the alteration of the operation of the ESP comprises stopping the ESP or bring the ESP to an idle state.

A fifty-ninth embodiment can include the method of the first through fifty-eighth embodiments, wherein the altering of the operation of the ESP comprises speeding up the ESP, in response to the parameter exceeding the threshold and the parameter being below another threshold.

A sixtieth embodiment can include the method of the first through fifty-ninth embodiments, further comprising determining that the slug is gas, determining that the gas slug is sufficiently small to not damage the ESP (e.g. below a threshold), and increasing the speed of the ESP (e.g. to try to maintain approximately constant fluid flow rate) through the pump.

A sixty-first embodiment can include the method of the first through sixtieth embodiments, further comprising determining the speed increase, wherein the speed increase is no more than the maximum speed at which the size of the slug detected will not damage the ESP.

A sixty-second embodiment can include the method of the first through sixty-first embodiments, wherein determining that the slug is gas comprises comparing/matching the data to a profile (e.g. historical data) indicative of gas and/or not indicative of sand (e.g. comparing data to profile for sand, gas, and/or normal).

A sixty-third embodiment can include the method of the first through sixty-second embodiments, further including determining depth/distance and speed of slug and setting time of the altering of the operation of the ESP to ensure that the alteration occurs before slug reaches ESP.

A sixty-fourth embodiment can include the method of the first through sixty-third embodiments, further including returning to the nominal speed of the ESP (e.g., nominal pump rate to the surface of the well) after the slug clears (e.g., passes through) the ESP.

A sixty-fifth embodiment can include the method of the first through sixty-fourth embodiments, further including continuing to monitor for slugs.

A sixty-sixth embodiment can include the method of the first through sixty-fifth embodiments, further including determining that the slug is in the horizontal section of the well, and taking action to slow the slug as the slug approaches the vertical section/bend.

A sixty-seventh embodiment can include the method of the first through sixty-sixth embodiments, further comprising removing the ESP while maintaining presence of the fiber optic cable in wellbore.

A sixty-eighth embodiment can include the method of the first through sixty-seventh embodiments, further comprising reinstalling the ESP in wellbore after the removal of the ESP, wherein the fiber optic cable remains in the wellbore and/or calibrating the system to tune to specific well (e.g. setting the threshold based on a specific/individual well) and/or wherein calibration is based on a data/profile from similar well(s) in area.

In a sixty-ninth embodiment, a method of training a model to classify slugs in a well having an electric submersible pump (ESP) and a distributed acoustic sensor (DAS) system, comprising generating a DAS signature by modeling slugs in a well; receiving flow noise recorded from a DAS system in a well; combining field-recorded DAS flow noise and the synthetic DAS signature to generate data; feature engineering the data; and training a machine learning model to classify slugs as being capable of affecting performance of an ESP, based on the feature engineered data.

A seventieth embodiment can include the method of the sixty-ninth embodiment, wherein the machine learning model is a supervised machine learning model.

A seventy-first embodiment can include the method of any of the sixty-ninth or seventieth embodiments, wherein the feature engineering comprises: receiving a differential phase time domain signal of the combined DAS flow noise and DAS signature; low-pass filtering the signal; integrating the signal over a time length to convert strain rate of the signal to strain data in a time domain; removing noise from the strain data, and standardizing the strain data; truncating the strain data at a depth interval and a time interval; and collapsing the truncated strain data to a single time series, and extracting amplitude and depth length of a tensional signature from the truncated strain data.

A seventy-second embodiment can include the method of any of the sixty-ninth through seventy-first embodiments, wherein the machine learning model is used to classify slugs in a physical well.

A seventy-third embodiment can include the method of any of the sixty-ninth through seventy-second embodiments, wherein an operation of the ESP, which is in the physical well, is changed, in response to classifying a slug in the physical well as being capable of affecting performance of the ESP.

A seventy-fourth embodiment can include the method of any of the sixty-ninth through seventy-third embodiments, wherein the operation of the ESP is changed by a controller, in response to the controller classifying the slug in the physical well as capable of affecting performance of the ESP, using the machine learning model.

A seventy-fifth embodiment includes a non-transitory computer-readable medium storing instructions that, when executed by a processor, cause the processor to perform the method of any of the sixty-ninth through seventy-fourth embodiments.

In a seventy-sixth embodiment, a method of pumping a fluid from a well having an electric submersible pump (ESP) and a distributed acoustic sensor (DAS) comprising receiving data from the DAS in the well; feature engineering the data to generate an engineering feature; classifying the engineering feature using a machine learning model; and in response to classifying the engineering feature as a slug capable of affecting performance of the ESP in the well, changing an operation of the ESP in the well.

A seventy-seventh embodiment can include the method of the seventy-sixth embodiment wherein the machine learning model is a supervised machine learning model.

A seventy-eighth embodiment can include the method of any of the seventy-sixth and seventy-seventh embodiment, wherein the feature engineering comprises sliding a truncated analysis window in time.

A seventy-ninth embodiment can include the method of any of the seventy-sixth through seventy-eighth embodiments, wherein the feature engineering comprises: applying a low-pass filter to a differential phase time domain signal from the DAS; integrating the signal over a time length to convert strain rate of the signal to strain data in a time domain; removing noise from the strain data, and standardizing the strain data; truncating the strain data at a depth interval and a time interval; and collapsing the truncated strain data to a single time series, and extracting amplitude and measured depth length of a tensional signature from the truncated strain data.

An eightieth embodiment can include the method of any of the seventy-sixth through seventy-ninth embodiments, wherein the classifying of the engineering feature comprises classifying the engineering feature by a controller using the machine learning model, and wherein the changing of the operation of the ESP comprises slowing down, idling, or stopping the ESP by the controller, in response to the controller classifying the engineering feature as the slug capable of affecting performance of the ESP.

An eighty-first embodiment can include the method of any of the seventy-sixth through eightieth embodiments, further comprising maintaining a current speed of the ESP, in response to classifying another engineering feature as not being a slug capable of affecting performance of the ESP.

An eighty-second embodiment can include a non-transitory computer-readable medium storing instructions that, when executed by a processor, cause the processor to perform the method of any of the seventy-sixth through seventy-first embodiments.

In an eighty-third embodiment, a method of training a model to classify slugs in a well having an electrical submersible pump (ESP) and a distributed acoustic sensor (DAS) comprising collecting data from a DAS in a well at a time period in which no slug affects performance of an ESP in the well; feature engineering the data; and training a machine learning model (e.g., creating a statistical model) to classify slugs as being capable of affecting performance of an electric submersible pump (ESP), based on the feature engineered data, using an anomaly detection model (e.g., using an autoencoder).

An eighty-fourth embodiment can include the method of the eighty-third embodiment, wherein the machine learning model is an unsupervised machine learning model.

An eighty-fifth embodiment can include the method of any of the eighty-third and eighty-fourth embodiments, wherein the feature engineering comprises: receiving a differential phase time domain signal from the DAS; low-pass filtering the signal; integrating the signal over a time length to convert strain rate of the signal to strain data in a time domain; removing noise from the strain data, and standardizing the strain data; truncating the strain data at a depth interval and a time interval; and collapsing the truncated strain data to a single time series, and extracting amplitude and measured depth length of a tensional signature from the truncated strain data.

An eighty-sixth embodiment can include the method of any of the eighty-third through eighty-fifth embodiments, wherein the machine learning model is used to classify slugs in another well, which is a physical well.

An eighty-seventh embodiment can include the method of any of the eighty-third through eighty-sixth embodiments, wherein an operation of another ESP is changed, in response to classifying a slug in the other well as being capable of affecting performance of the other ESP based on the model.

An eighty-eighth embodiment can include the method of any of the eighty-third through eighty-seventh embodiments, wherein the operation of the other ESP is changed by a controller, in response to the controller classifying the slug in the other well as being capable of affecting performance of the other ESP, using the machine learning model.

An eighty-ninth embodiment can include a non-transitory computer-readable medium storing instructions that, when executed by a processor, cause the processor to perform the method of any of the eighty-third through eighty-eighth embodiments.

In a ninetieth embodiment, a method of pumping fluid from a well having an electric submersible pump (ESP) and a distributed acoustic sensor (DAS) system, comprising receiving data from the DAS in the well; feature engineering the data to generate an engineering feature; outputting an anomaly estimation factor, using a machine learning model, based on the engineering feature; and in response to the anomaly estimation factor exceeding a threshold, changing an operation of the ESP in the well.

A ninety-first embodiment can include the method of the ninetieth embodiment, wherein the machine learning model is an unsupervised machine learning model.

A ninety-second embodiment can include the method of any of the ninetieth and ninety-first embodiments, wherein the feature engineering comprises sliding a truncated analysis window in time.

A ninety-third embodiment can include the method of any of the ninetieth through ninety-second embodiments, wherein the feature engineering comprises: applying a low-pass filter to a differential phase time domain signal from the DAS; integrating the signal over a time length to convert strain rate of the signal to strain data in the time domain; removing noise from the strain data, and standardizing the strain data; truncating the strain data at a depth interval and a time interval; and collapsing the truncated strain data to a single time series, and extracting amplitude and measured depth length of a tensional signature from the truncated strain data.

A ninety-fourth embodiment can include the method of any of the ninetieth through ninety-third embodiments, wherein the changing of the operation of the ESP comprises slowing down, idling, or stopping the ESP by a controller, in response to the controller determining that the anomaly estimation factor exceeds the threshold.

A ninety-fifth embodiment can include the method of any one of the ninetieth through ninety-fourth embodiments, further comprising maintaining a current speed of the ESP, in response to classifying another engineering feature as not being a slug capable of affecting performance of the ESP.

A ninety-sixth embodiment can include the method of any one of the ninetieth through ninety fifth embodiments, further comprising recalibrating the model, in response to an anomaly estimation factor associated with another engineering feature not exceeding the threshold and a slug associated with the engineering feature affecting performance of the ESP.

A ninety-seventh embodiment can include a non-transitory computer-readable medium storing instructions that, when executed by a processor, cause the processor to perform the method of any of the ninetieth through ninety-sixth embodiments.

In a ninety-eighth embodiment, a method of operating an ESP in a well to pump fluid comprises training a model to detect potentially damaging slugs in the well; receiving data from DAS (and/or other sensors) relating to well conditions; using the trained model to evaluate the data in real time; and based on the evaluation, determining an action for the ESP.

A ninety-ninth embodiment can include the method of the ninety-eighth embodiment, further comprising iteratively collecting data (e.g. DAS sensor data), recalibrating the model based on the data, and applying the recalibrated model to evaluate data in real time.

A one-hundredth embodiment can include the method of the ninety-eight or ninety-ninth embodiments, wherein the model comprises a supervised model.

A one-hundred-first embodiment can include the method of the ninety-eight or ninety-ninth embodiments, wherein the model comprises an unsupervised model.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R1+k*(Ru-RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "of" does not require selection of only one element. Thus, the phrase "A or B" is satisfied by either element from the set {A, B}, including multiples of any either element; and the phrase "A, B, or C" is satisfied by any element from the set {A, B, C} or any combination thereof, including multiples of any element. A clause that recites "A, B, or C" can be infringed with only one of the listed items, multiple of the listed items, and one or more of the items in the list and another item not listed.

As used herein, the terms "a" and "an" mean "one or more." As used herein, the term "the" means "the one or more." Thus, the phrase "an element" means "one or more elements;" and the phrase "the element" means "the one or more elements."

As used herein, the term "and/of" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A system for producing a fluid from a well, comprising:
- an electrical submersible pump (ESP) disposed in a wellbore of the well and configured to pump the fluid;
- a distributed acoustic sensing (DAS) system comprising an interrogator unit, and a fiber optic cable extending from a surface of the well into the wellbore, wherein a distal end of the fiber optic cable is disposed downhole relative to the ESP; and
- a controller configured to:
  - receive data from the DAS system;
  - evaluate the data to detect a slug;
  - determine a parameter of the detected slug;
  - compare the parameter to a threshold; and
  - alter operation of the ESP, in response to the parameter exceeding the threshold,
- wherein the slug is detected based on a tension in the fiber optic cable.

2. The system of claim 1, wherein the interrogator unit comprises a light source configured to emit coherent light into the fiber optic cable, a receiver configured to receive backscattered light from the fiber optic cable, and a processor configured to generate the data based on the backscattered light and send the data to the controller.

3. The system of claim 1, wherein the slug is further detected based on a measured depth range of the slug.

4. The system of claim 1, wherein the parameter comprises a depth range of the slug, the tension in the fiber optic cable, a magnitude of an acoustic signal received by the fiber optic cable, an estimated length of the slug, an estimated volume of the slug, or an estimated mass of the slug.

5. The system of claim 1, wherein the parameter comprises a severity rating based on at least one of a position of the slug, a velocity of the slug, a length of the slug, a volume of the slug, and a mass of the slug.

6. The system of claim 1, wherein the parameter comprises a mass of the slug, and the mass of the slug is estimated based on a measured depth range of the slug, the tension in the fiber optic cable, a magnitude of acoustic signal received by the fiber optic cable, or combinations thereof.

7. The system of claim 1, wherein the slug is a gas slug or a sand slug in the fluid.

8. The system of claim 1, wherein the alteration of the operation of the ESP comprises stopping the ESP or bringing the ESP to an idle state.

9. The system of claim 1, wherein the controller is further configured to alter the operation of the ESP by speeding up the ESP, in response to detecting that the parameter exceeds the threshold and the parameter is below another threshold.

10. The system of claim 1, wherein the distal end of the fiber optic cable is disposed a distance downhole of the ESP, and wherein the distance is an effective distance to provide advanced warning of the slug.

11. The system of claim 1, wherein the controller is further configured to alter operation of the ESP at a time based on an estimated position of the slug and an estimated velocity of the slug.

12. The system of claim 11, wherein the time is sufficiently advanced for alteration of the operation of the ESP to occur prior to arrival of the slug at the ESP.

13. A method of installing a system for producing fluid from a well, comprising:
- installing a distributed acoustic sensing (DAS) system, wherein the installing of the DAS system comprises:
  - deploying a fiber optic cable into a wellbore of the well; and
  - attaching an interrogator unit to a first end of the fiber optic cable;
- placing an electrical submersible pump (ESP) into the wellbore, wherein a second end of the fiber optic cable is disposed downhole with respect to the ESP; and
- placing a controller into communication with the DAS system, wherein the controller is configured to:
  - receive data from the DAS system;
  - evaluate the data to detect a slug;
  - determine a parameter of the detected slug;
  - compare the parameter to a threshold; and
  - alter operation of the ESP, in response to the parameter exceeding the threshold,
- wherein the slug is detected based on a tension in the fiber optic cable.

14. The method of claim 13, wherein the parameter comprises a depth range of the slug, the tension in the fiber optic cable, a magnitude of an acoustic signal received by the fiber optic cable, an estimated length of the slug, an estimated volume of the slug, or an estimated mass of the slug.

15. The method of claim 13, wherein the parameter comprises a severity rating based on at least one of a position of the slug, a velocity of the slug, a length of the slug, a volume of the slug, and a mass of the slug.

16. The method of claim 13, wherein the parameter comprises a mass of the slug, and the mass of the slug is estimated based on a measured depth range of the slug, the tension in the fiber optic cable, and a magnitude of acoustic signal received by the fiber optic cable or combinations thereof.

17. A method of producing fluid from a well, comprising:

pumping the fluid by an electrical submersible pump (ESP), wherein the ESP is disposed in a wellbore of the well;

gathering data by a distributed acoustic sensing (DAS) system, wherein a fiber optic cable of the DAS system extends from a surface of the well into the wellbore, and a distal end of the fiber optic cable is disposed downhole relative to the ESP;

evaluating the data to detect a slug;

determining a parameter of the detected slug;

comparing the parameter to a threshold; and altering operation of the ESP, in response to the parameter exceeding the threshold, wherein the slug is detected based on a tension in the fiber optic cable.

18. The method of claim 17, wherein the parameter comprises a depth range of the slug, a magnitude of an acoustic signal received by the fiber optic cable, an estimated length of the slug, an estimated volume of the slug, or an estimated mass of the slug.

19. The method of claim 17, wherein the altering of the operation of the ESP comprises stopping the ESP or bringing the ESP to an idle state.

20. The method of claim 17, wherein the altering of the operation of the ESP comprises speeding up the ESP, in response to the parameter exceeding the threshold and the parameter being below another threshold.

* * * * *